US006311618B1

(12) United States Patent
Okumura et al.

(10) Patent No.: US 6,311,618 B1
(45) **Date of Patent: *Nov. 6, 2001**

(54) STAMP UNIT WITH A CIRCUMFERENCE PORTION COVERED BY A SEALANT

(75) Inventors: Takashi Okumura; Hiroshi Takami; Teruo Imamaki, all of Aichi; Minoru Yamamoto, Mie; Mitsunobu Suda, Aichi; Keiji Seo, Aichi; Hiroshi Taira, Aichi, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,777

(22) Filed: Jun. 20, 2000

Related U.S. Application Data

(60) Division of application No. 09/350,678, filed on Jul. 12, 1999, now Pat. No. 6,112,662, which is a continuation-in-part of application No. 08/948,592, filed on Oct. 10, 1997, now Pat. No. 6,047,638.

(30) Foreign Application Priority Data

| | | |
|---|---|---|
| Oct. 16, 1996 | (JP) | 8-273635 |
| Sep. 17, 1998 | (JP) | 10-263024 |
| Sep. 18, 1998 | (JP) | 10-264406 |
| Sep. 22, 1998 | (JP) | 10-267647 |
| Sep. 28, 1998 | (JP) | 10-272396 |

(51) Int. Cl.[7] ..... B41K 1/36; B41K 1/02

(52) U.S. Cl. ..... 101/379; 101/405; 101/368; 101/125

(58) Field of Search ..... 101/135, 133, 101/405, 406, 125, 379, 368, 327, 329, 333, 334

(56) References Cited

U.S. PATENT DOCUMENTS

| | | | |
|---|---|---|---|
| 2,346,023 | 4/1944 | Gold | 101/125 |
| 3,303,146 | 2/1967 | Chebiniak | 521/65 |
| 3,855,925 | 12/1974 | Funahashi | 101/333 |
| 4,212,839 | 7/1980 | Funahashi | 264/45.3 |
| 4,484,827 | 11/1984 | Price, Jr. | 101/333 |
| 4,939,990 | 7/1990 | Inaguma et al. | 101/405 |
| 5,577,444 | 11/1996 | Toyama | 101/379 |
| 5,611,279 | 3/1997 | Ando et al. | 101/401.1 |
| 5,636,569 | 6/1997 | Winston | 101/333 |
| 5,741,459 | 4/1998 | Ando et al. | 264/293 |
| 5,765,484 | 6/1998 | Lam | 101/327 |
| 5,771,806 | 6/1998 | Imamaki | 101/333 |
| 5,829,352 | 11/1998 | Taira et al. | 101/327 |

FOREIGN PATENT DOCUMENTS

| | | |
|---|---|---|
| 0 798 114 | 10/1997 | (EP) . |
| 2 191 479 | 2/1974 | (FR) . |
| 55-13729 | 1/1980 | (JP) . |
| 05 058015 | 3/1993 | (JP) . |
| 7-82505 | 4/1995 | (JP) . |
| 7-89205 | 4/1995 | (JP) . |
| 7-214883 | 8/1995 | (JP) . |
| 07-251558 | 10/1995 | (JP) . |
| 7-285258 | 10/1995 | (JP) . |
| 10-52574 | 3/1998 | (JP) . |
| 9-249983 | 3/1999 | (JP) . |
| WO 95/09730 | 4/1995 | (WO) . |
| WO 95/11283 | 4/1995 | (WO) . |

*Primary Examiner*—Daniel J. Colilla
(74) *Attorney, Agent, or Firm*—Oliff & Berridge, PLC

(57) ABSTRACT

The disclosed invention is a stamp unit that includes a holder member having an end. A stamp material is made of a porous material retained by the holder member. The stamp material has a front surface projected form the end of the holder member and a circumference portion. The front surface includes an effective stamp surface that includes a stamping portion and a non-stamping portion. The circumference portion is defined at least by an area existing between positions corresponding to the end of the holder member and the effective stamp surface, within an exposed area of the stamp material from the holder member, the area being entirely covered by a sealant.

14 Claims, 18 Drawing Sheets

STAMP UNIT WITH A CIRCUMFERENCE PORTION COVERED BY A SEALANT

This is a Continuation of application Ser. No. 09/350,678 filed Jul. 12, 1999, now U.S. Pat. No. 6,112,662, which in turn is a Continuation-in-Part of application Ser. No. 08/948,592 filed Oct. 10, 1997, now U.S. Pat. No. 6,047,638. The entire disclosure of the prior applications is hereby incorporated by reference herein in its entirety.

BACKGROUND OF THE INVENTION

1. Field of the Invention

The present invention relates to a stamp unit provided ith a holder which is vertically and slidably disposed in a skirt member and retains a stamp material at the lower side and a grip member which is disposed above the holder and moves it downward, and more particularly to a stamp unit which can improve stamping durability of the stamp material retained at the lower side of the holder against a stamping sheet such as a paper.

Further, the present invention relates to a stamp unit having a stamp material made of porous material with an effective stamping surface capable of stamping and a holder retaining the stamp material at the lower side, and more particularly to a stamp unit which can surely prevent ink leakage from a circumference portion around the effective stamping surface included in a surface of the stamp material exposed from the lower side of the holder.

2. Description of Related Art

Conventionally, the stamp unit of various types has been proposed. One type of the stamp unit is disclosed in Japanese patent application No. Hei 10-52574 which was filed by the present applicant. This stamp unit comprises a grip, a holder, and a skirt member. The holder is connected with the grip so that the holder is vertically movable within the skirt member, nd a stamp forming material is disposed at a lower side of the older.

In the stamp unit, the stamp forming material has a two-layered configuration comprised of an upper layer made of porous hard resin and a lower layer made of porous soft resin in which optical energy absorbing material, such as carbon black, etc., is dispersed. To produce a stamp plate from this stamp forming material by means of a stamp manufacturing device, at first, while a part of rolled-up transparent film is drawn out and fed from the roll, characters and figures are printed on the film through a thermal ink ribbon by a thermal head. Thereby a positive manuscript is formed. Subsequently, the holder with the stamp forming material is set to a predetermined position in the stamp manufacturing device so that the positive manuscript and the lower layer of the stamp forming material are mutually opposed while a transparent acrylic plate exists between the positive manuscript and the stamp forming material. In this state, the lower layer of the stamp forming material is depressed to the transparent acrylic plate. In such the state, when a xenon tube disposed below the transparent acrylic plate is driven to emit light, the lower layer of the stamp forming material is irradiated with the light through the positive manuscript. The part of the lower layer irradiated with light at sites corresponding to the transparent portion of the manuscript is then fused due to heating effect of the optical absorbing material of the lower layer, and solidified. Thereby, the irradiated part is sealed and becomes ink-impermeable. On the other hand, the part of the lower layer corresponding to the characters and the like on the manuscript is not fused-solidified and remains as it is, thus a stamp plate having a stamping surface on a lower face thereof is formed. In the stamping surface, a sealed portion(non-stamping portion) and a non-sealed portion(stamping portion) with a desirable pattern are mixed. The effective stamping surface of the stamp plate is constructed from the above surface in which the stamping portion and the non-stamping portion are mixed. Usually, in the stamp plate, the effective stamping surface corresponds to a flat surface except for the circumference portion along the holder within the surface of the stamp plate.

Further, in the above stamp unit, an ink pack filled with ink can be set in the storage part of the holder, the storage part having a bottom plane on which uneven portions are formed in lattice. When the grip is depressed downward, the ink pack is put between a plate member arranged at the lower end of the grip and the bottom plane of the storage part, thereby the ink pack is broken and opened. The ink flowed out of the opened ink pack is stored in the upper layer and the lower layer of the stamp plate. The ink oozes only from the non-sealed portion on the lower layer of the stamp plate and does not ooze from the sealed portion.

To print characters and the like with the stamp unit, the skirt member of the stamp unit is positioned on a desirable position of the stamping sheet and the grip is depressed downward. Then, the holder moves downward in the skirt member and the stamping surface of the stamp plate is pressed onto the stamping sheet. Thereby, the ink oozes onto the stamping sheet from the non-sealed portion existing in the effective stamping surface of the stamp plate and stamping of characters and the like is conducted onto the stamping sheet. When stamping, it is necessary that the ink does not ooze from the exposed portion except for the effective stamping surface.

However, in the above stamp unit, it is conceivable that tens of thousands of stamping operations are conducted. Therefore, in case that the stamp plate is insufficiently retained to the holder, the ink is apt to ooze from a gap between the holder and the stamp plate. In a more extreme case, the stamp plate comes off the holder.

And if the stamp plate is strongly depressed when stamping, the ink oozes from the circumference portion of the stamp plate. As a result, it concludes that undesirable stamping is conducted.

SUMMARY OF THE INVENTION

The present invention has been made in view of the above circumstances and has an object to overcome the above problems and to provide a stamp unit in which a stamp material can be surely retained to a holder and stamping durability can be improved by firmly sealing a circumference portion of the stamp material if stamping is repeated.

Further, it is another object of the present invention to provide a stamp unit through which ink can be reliably prevented from oozing from a portion except for an effective stamping surface of the porous stamp material exposed from the holder, for example from the circumference portion of the effective stamp surface between the holder and the stamp material.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a stamp unit including a skirt member, a holder member slidably retained in the skirt member, the holder member having an upper end and a lower end, a stamp material retained at the lower end of the holder member, the stamp material including ink therein and having an effective stamp surface for stamping by ink, and a grip member connected to the upper end of the holder member for moving the holder member.

A portion of the stamp material except for the effective stamp surface is sealed by sealing process so that ink included in the stamp material does not leak from the portion.

According to the stamp unit of the present invention, since the portion of the stamp material except for the effective stamp surface is sealed by sealing process, it can prevent ink included in the stamp material from leaking from the stamp material. Thus, even if stamping operation is repeated many times, ink leakage can be avoided, therefore stamping durability can be improved without occurrence of unnecessary stamping around the effective stamp surface.

Here, it is preferable that the sealing process is conducted on a circumference portion of the stamp material around the effective stamp surface.

The sealing process may be done on the circumference portion by a heat-press process by a heat-press jig or by applying a sealant to the circumference portion. Taking one of the heat-press process and the sealant process, it can surely prevent ink included in the stamp material from leaking from the circumference portion of the stamp material.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

In the drawings.

DETAILED DESCRIPTION OF THE PREFERRED EMBODIMENTS

Figure 1:
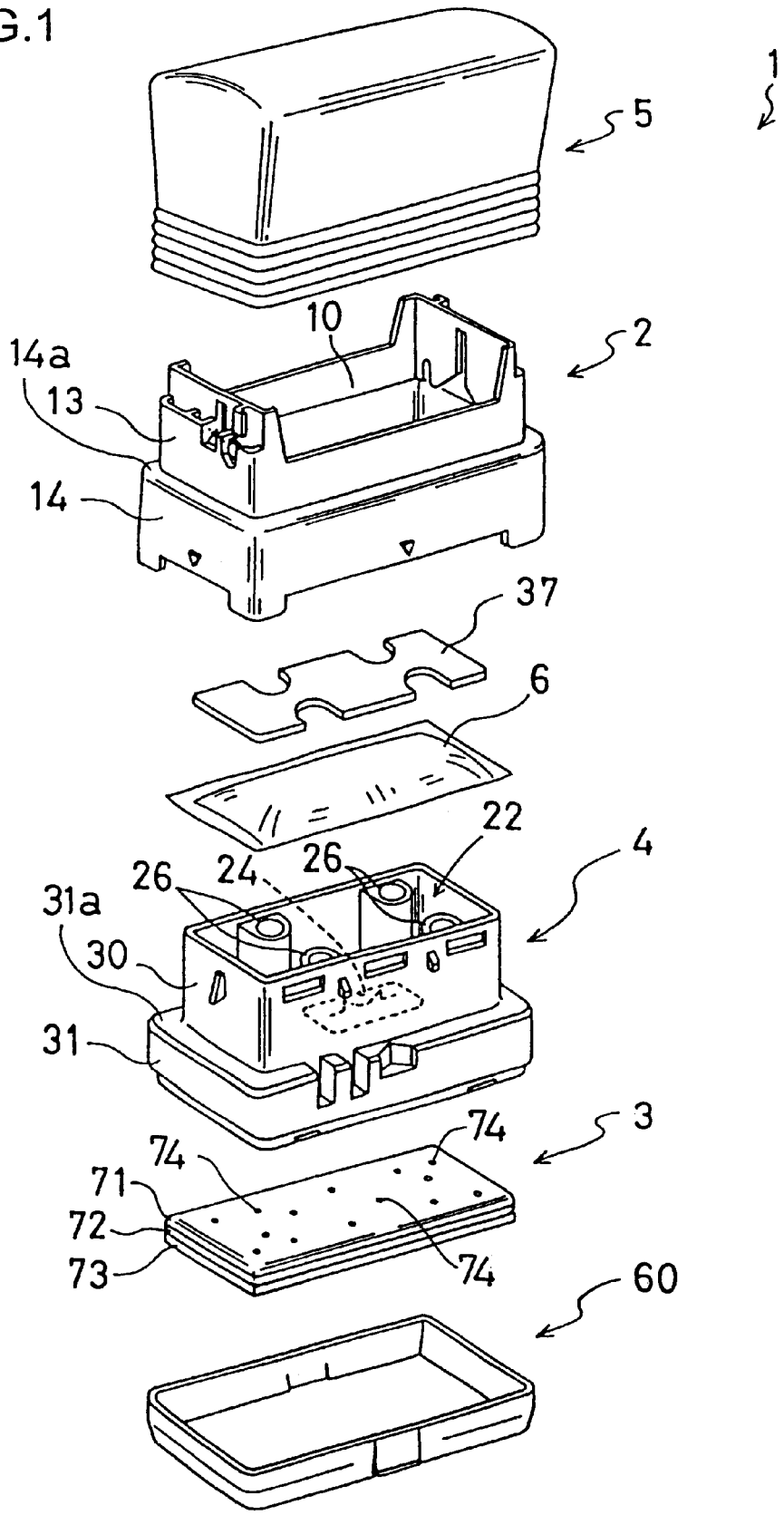
FIG. 1 is a whole exploded perspective view of a stamp unit according to the first embodiment of the present invention.
Figure 2:
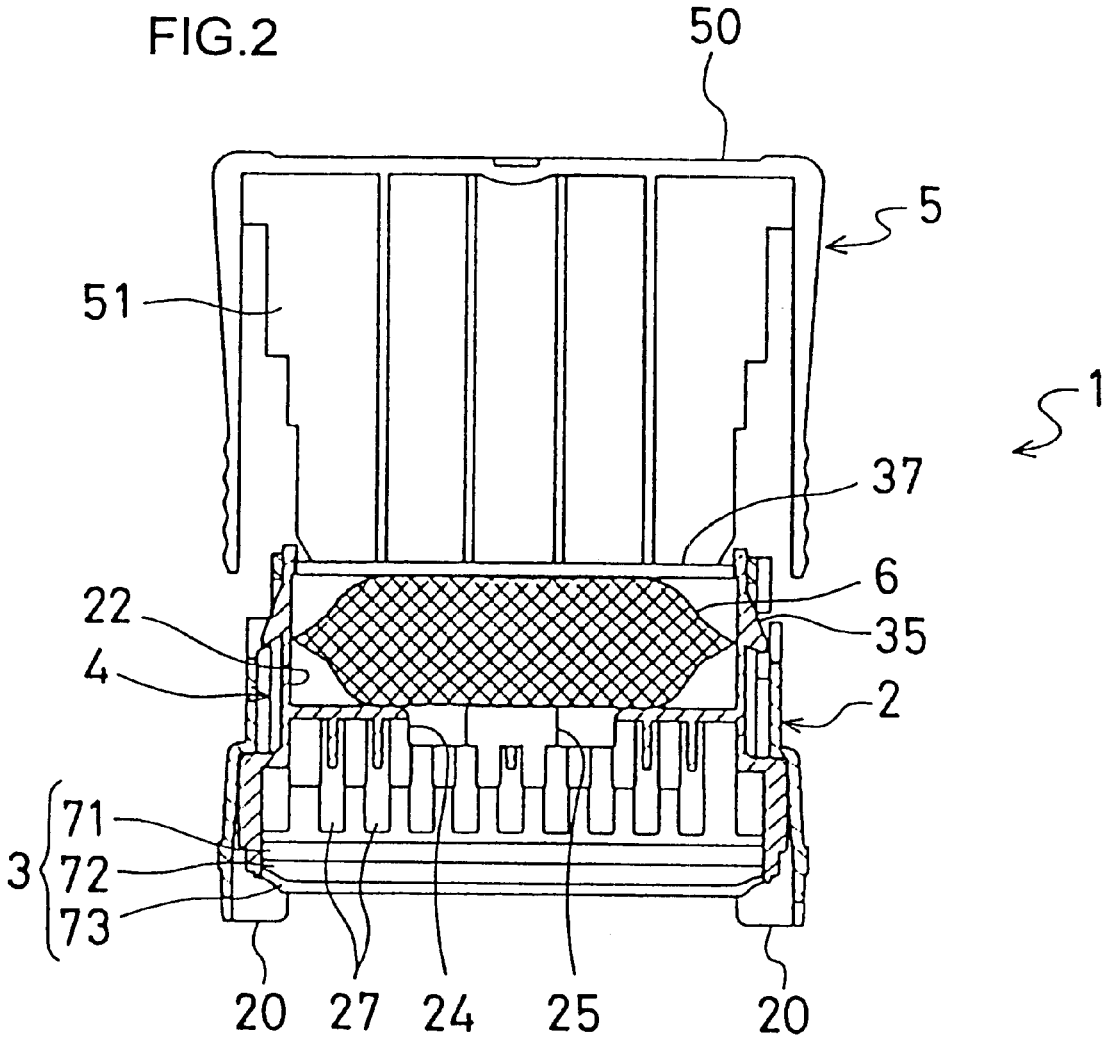
FIG. 2 is a cross sectional view of the stamp unit before an ink pack is opened.
Figure 3:
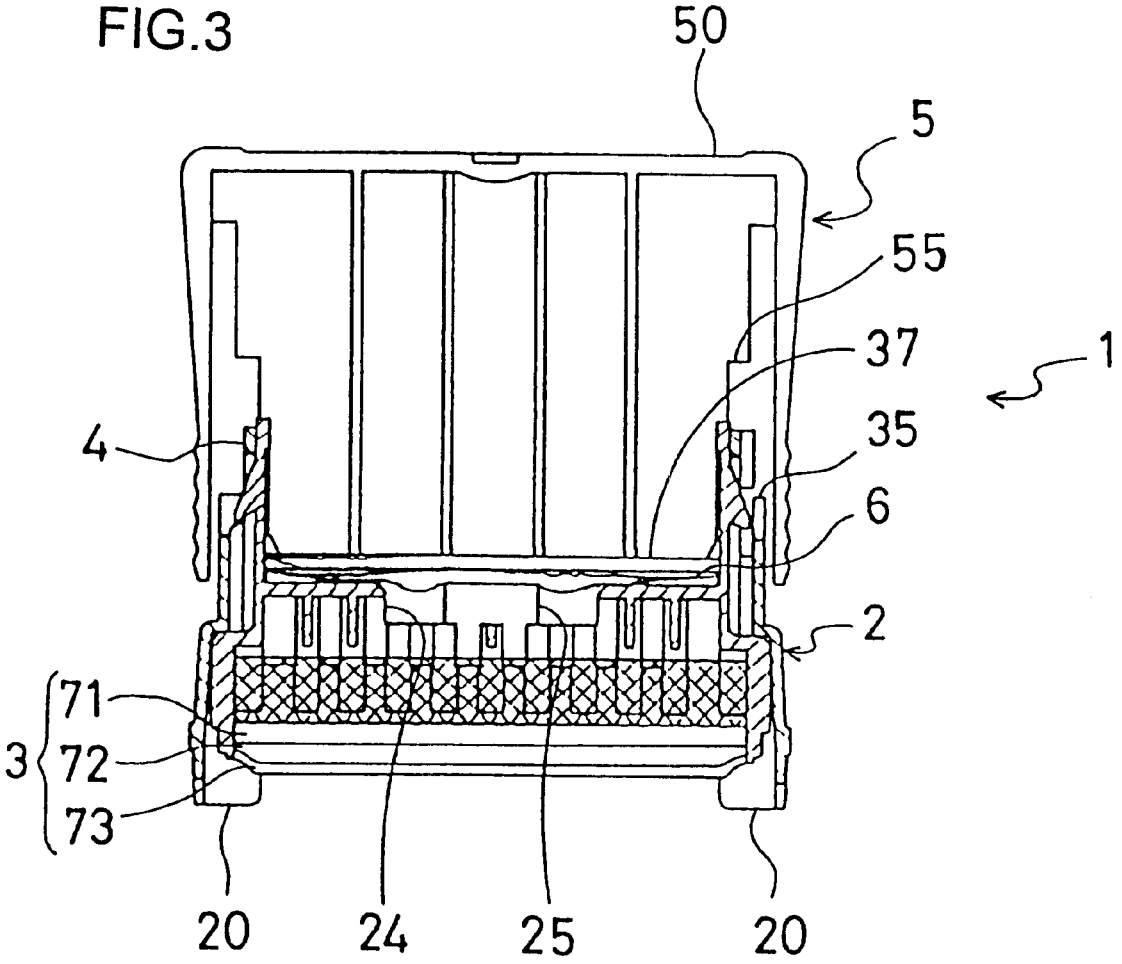
FIG. 3 is a cross sectional view of the stamp unit right after the ink pack is opened.

A detailed description of preferred embodiments of a stamp unit embodying the present invention will now be given referring to the accompanying drawings. At first, the structure of the stamp unit in the first embodiment is explained with reference to FIGS. 1 to 3. Here, FIG. 1 is a whole perspective view of a stamp unit according to the first embodiment of the present invention, FIG. 2 is a cross sectional view of the stamp unit before an ink pack is opened, and FIG. 3 is a cross sectional view of the stamp unit right after the ink pack is opened As shown in FIGS. 1 to 3, a stamp unit 1 is mainly constituted of a skirt member 2 for supporting the whole stamp unit 1 during a stamping operation, a holder 4 which is disposed slidably in a vertical direction within the skirt member 2 and holds a stamp material 3 at the lower side by a heat-press process (mentioned hereinafter), a grip member 5 which is joined with the holder 4 such that the holder 4 is moved down during stamping thereby to press the stamp material 3 against a stamping sheet (not shown), and a cap member 60 for covering and protecting the stamp material 3 retained at the lower side of the holder 4.

A storage area 22 formed in the holder 4 is constructed so as to receive an ink pack 6. The ink pack 6 is formed of a pack made of film material, filled up with ink. In the ink pack 6, ink is packed so that ink quantity is substantially equal to ink quantity which the stamp material 3 can store therein. A cardboard member 37 is arranged between the ink pack 6 and the bottom face of the grip member 5. The film material of the ink pack 6 is selected from polyethylene, polypropylene, polyester, nylon, etc. or two kinds sheet-like materials bonded together.

Figure 4:
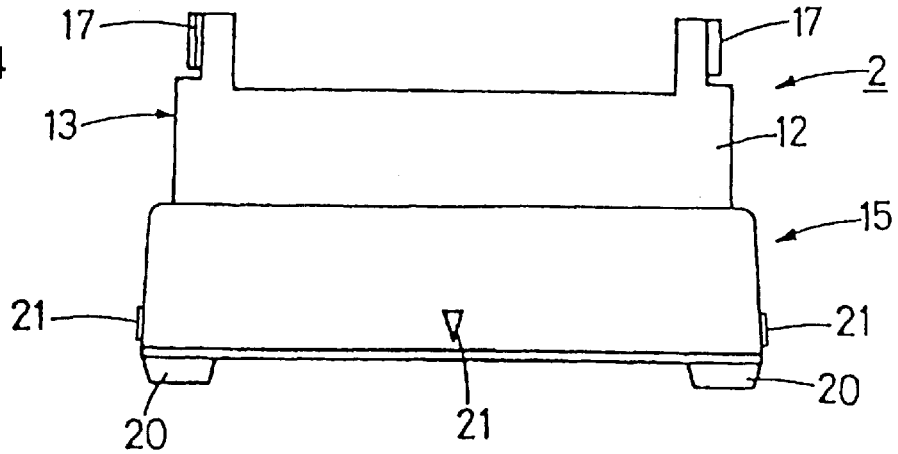
FIG. 4 is a side view of a skirt member.
Figure 5:
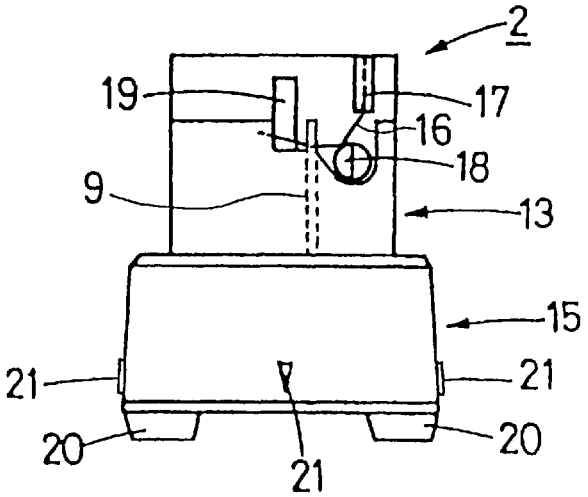
FIG. 5 is an end face view of the skirt member.
Figure 6:
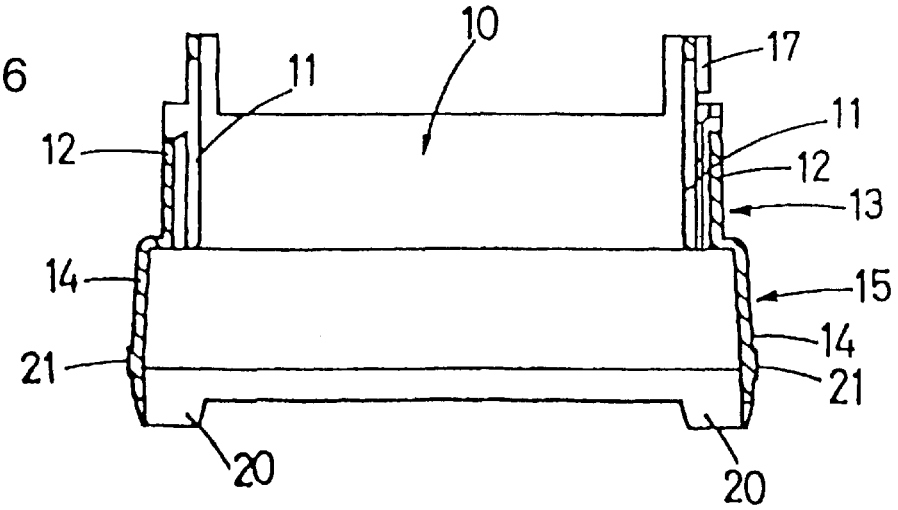
FIG. 6 is a cross sectional view of the skirt member.

Successively, the skirt member 2 is explained with reference to FIG. 4 to FIG. 6. FIG. 4 is a side view of a skirt member, FIG. 5 is an end face view of the skirt member, and FIG. 6 is a cross sectional view of the skirt member. In those drawings, the skirt member 2 has an open cavity 10 which is substantially rectangular in a top view, an upper skirt portion 13 provided with an interior wall 11 defining the open cavity 10 in which the holder 4 is slidably inserted and an exterior wall 12 formed in the outside of and integrally with the interior wall 11, and a lower skirt portion 15 provided with an exterior wall 14 formed with the bottom portion slightly widened continuously from the exterior walls 12.

On each end surface (right and left end faces in FIG. 4) of the upper skirt portion 13, there is formed a spring stopper 17 in an upper side of the interior wall 11. This spring stopper 17 serves to stop one end of a torsion spring 16 (see FIG. 5) whereby the holder 4 is always urged upward in the cavity 10. Obliquely below the spring stopper 17, a semi-circular positioning projection 18 is formed (see FIG. 5). A coiled portion of the spring 16 is mounted around the projection 18 thereby to position the coiled portion. A vertical slot 19 is formed in the interior wall 11 in the center. This slot 19 has an open lower end such that a sloped projection 35, which will be mentioned later, formed on either end surface of the holder 4 (see FIG. 7) is inserted in the slot 19 and slidable in a vertical direction. The vertical slot 19 serves to vertically guide the sloped projection 35 of the holder 4 in moving downward for stamping. Between the vertical slot 19 and the positioning projection 18, a spring limit member 9 is formed as shown in FIG. 5. The spring limit member 9 limits the torsion spring 16 so as not to move in a direction that the spring 16 separates from the end surface of the holder 4 and acts to prevent disengagement between the torsion spring 16 and the lower end of the sloped projection 35.

The lower skirt portion 15 is to be put on a stamping sheet during the stamping operation, thus supporting the entire stamp unit 1 on the printing sheet. The exterior wall 14 forming the lower skirt portion 15 has projections 20 formed on the lower corners respectively. With the support projections 20, the lower end of the exterior wall 14 of the lower skirt portion 15 is retained away from the stamping sheet. It is to be noted that the exterior wall 14 is formed with a downward-arrow-shaped raised portion 21 located in each center of four surfaces of the wall 14 as shown in FIGS. 4 and 5. This raised portion 21 indicates a stamping direction.

Figure 7:
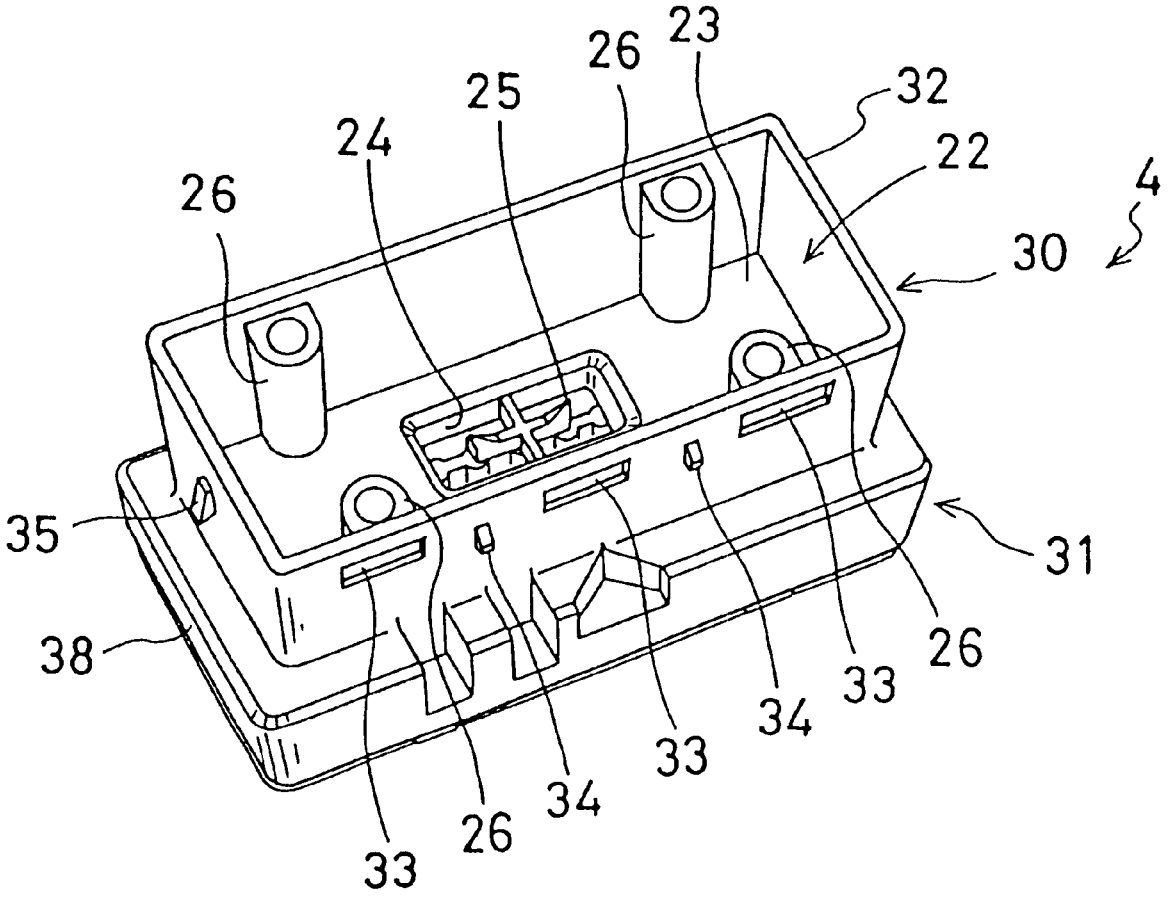
FIG. 7 is a perspective view of a holder.
Figure 8:
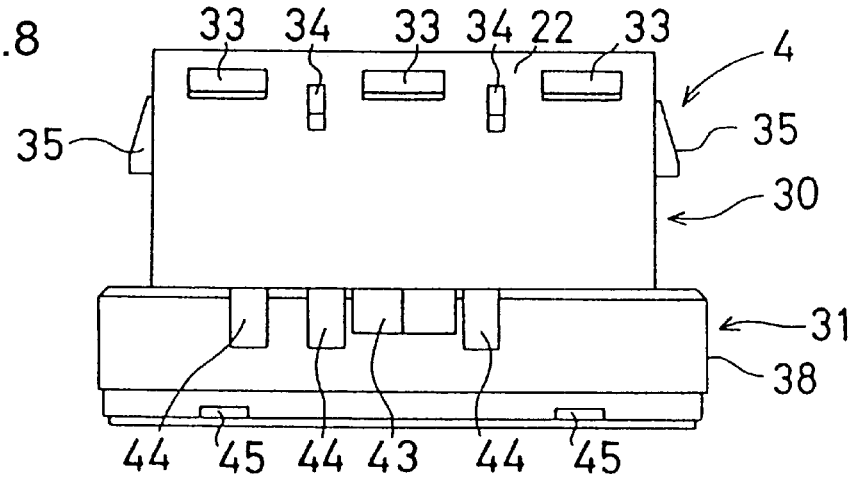
FIG. 8 is a side view of the holder.
Figure 9:
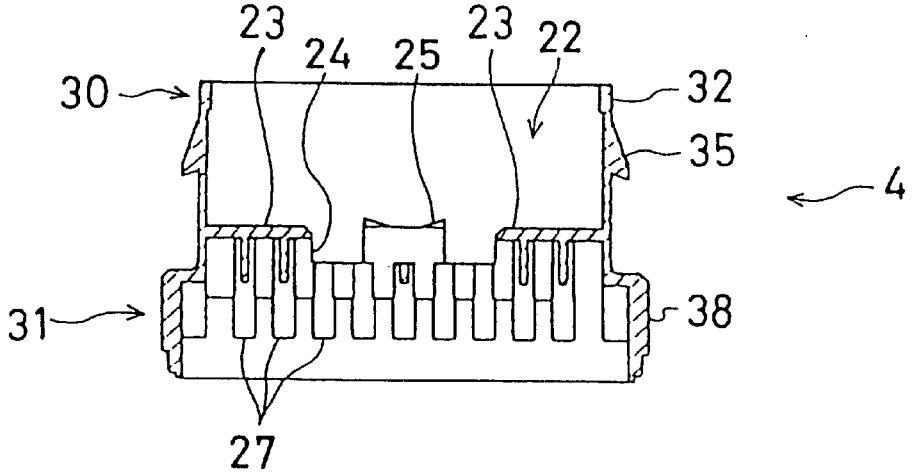
FIG. 9 is a cross sectional view of the holder.
Figure 10:
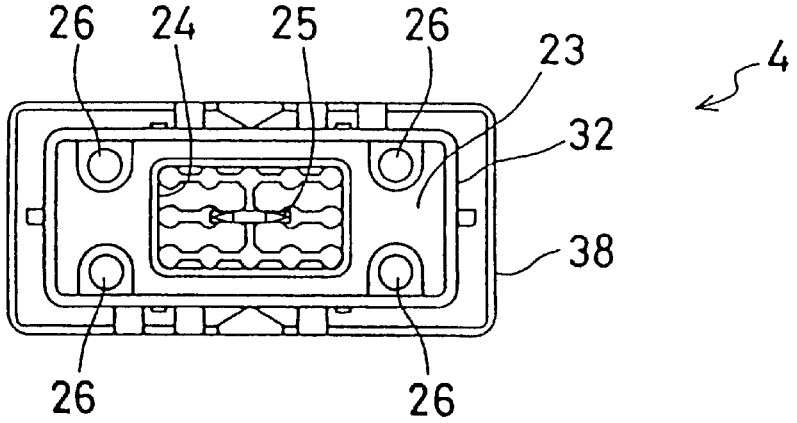
FIG. 10 is a plan view of the holder.
Figure 11:
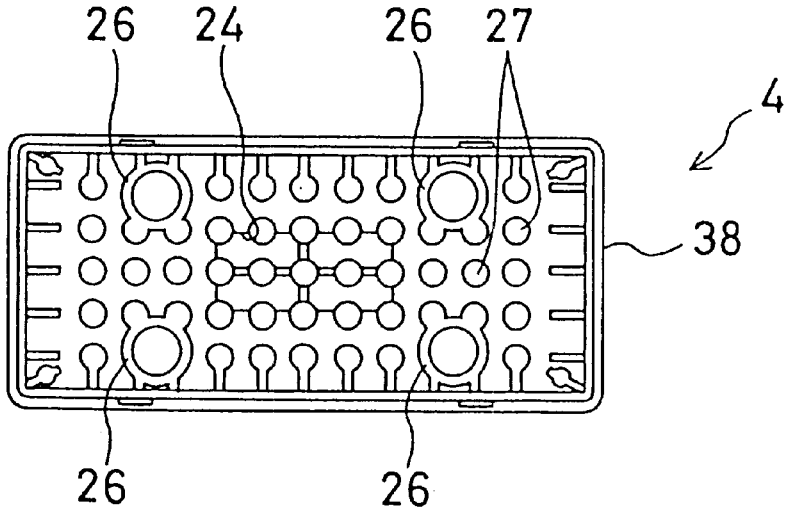
FIG. 11 is a bottom view of the holder.

Next, description is made on the holder 4 with reference to FIGS. 7 to 11. FIG. 7 is a perspective view of the holder 4, FIG. 8 is a side view of the holder 4, FIG. 9 is a cross sectional view of the holder 4, FIG. 10 is a plan view of the holder 4, and FIG. 11 is a bottom view of the holder 4.

In those drawings, the holder 4 is constituted of an upper holder portion 30 and a lower holder portion 31, which are formed integrally and corresponding to the upper and lower skirt portions 13 and 15 respectively. The upper holder portion 30 has a peripheral wall 32 formed from an angular cylindrical body having a substantially rectangular cross section. On the upper side of front and rear wall portions (only one of them is shown in FIG. 8) of the cylindrical wall 32, there are formed three grooves 33 arranged horizontally and wedge-shaped restrictive projections 34 which slope downward from the outer surface of the wall 32 to the outside on both sides of the center groove 33. Each of the grooves 33 is engaged with a rib groove 54 (mentioned later) of the grip member 5, such that the holder 4 is integrally connected with the grip member 5. The restrictive projections 34 come into contact with the upper end of the exterior wall 12 of the upper skirt portion 13 as the holder 4 is moved down for the stamping operation, and then serve to restrict the downward motion of the holder 4.

A wedge-shaped projection 35 formed sloping downward from the wall 32 to the outside is provided on either side surface (right and left side surfaces in FIG. 8) of the wall 32 of the upper holder portion 30. This sloped projection 35 is slidably inserted in the vertical slot 19 of the upper skirt portion 13 as the holder 4 is inserted into the skirt member 2 from its lower opening. One end of the torsion spring 16 traverses the slot 19 and is stopped in contact with the lower end of the projection 35 inserted in the slot 19, as shown in FIG. 5. This structure enables the vertical sliding of the holder 4 within the skirt member 2 by cooperation between the sloped projections 35 and the vertical slots 19. Another end of the torsion spring 16 is fixedly inserted in the spring stopper 17 of the upper skirt portion 13 while the opposite end of the spring 16 is stopped by the projection 35 as mentioned above, so that the holder 4 is always urged upward in the skirt member 2.

A bottom face 23 of the storage area 22, the storage area 22 having a form corresponding to a substantial rectangular parallelopiped shape surrounded by the cylindrical wall 32 of the upper holder portion 30 in the holder 4, has a flat plane, and an ink supply hole 24 communicating with the lower holder portion 31 is formed in the center position of the bottom face 23. In the ink supply hole 24, cutting rib 25 to break and open the ink pack 6 are formed so as to slightly project upward from the bottom face 23.

Four ink supply elongated holes 26 are formed on the interior wall surface of the front and rear walls of the wall 32 as shown in FIG. 7. Each ink supply hole 26 is elongated from the upper end of the holder 4 to bottom surfaces of support posts 27 (see FIG. 11). This supply hole 26 is used for auxiliary supply of ink in case that the ink supplied from the ink pack 6 and included in the stamp material 3 is decreased. At this time, the ink is poured to the stamp material 3 through the ink supply hole 26 when the grip member 5 has been detached from the holder 4.

As shown in FIG. 11, many columnar support posts 27 with height of several millimeters are arranged in lattice on the lower holder portion 31 of the holder 4. Each support post 27 is elongated to a position that the lower end of the support post 27 is slightly retracted upward from the lower end of the lower holder portion 31 and contacts with the upper surface of the stamp material 3 retained by the holder 4. The lower end surfaces of the support posts 27 substantially construct one surface. The lower holder portion 31 is integrally formed with the upper holder portion 30 and has a peripheral wall 38 with dimensions larger than the wall 32. The holder 4 is formed of ABS resin, polyolefine resin such as polyacetal copolymer, polypropylene, polyethylene, nylon, etc., PC resin, and the like.

The cutting rib 25 presses the ink pack 6 against the cardboard 37 as the grip member 5 is pressed down, such that the part of the ink pack 6 caught between the cutting ribs 25 and the cardboard 37 is broken and opened. To ensure the opening of the ink pack 6, the cutting ribs 25 are formed having sharp-pointed corners. The ink supply hole 24 guides the ink flowed out of the ink pack 6 opened by the cutting ribs 25 downward, thereby the ink is absorbed into the stamp material 3.

A wedge-shaped slant recess 43, slanting inward, is provided at a substantial center position on each outer surface of the front and rear walls (long walls) of the peripheral wall 38 constructing the lower holder portion 31. On both sides of the slant recess 43, one or two detection recesses 44 are formed. When a stamp surface is formed on the stamp material 3 by means of the stamp manufacturing device which is disclosed in Japanese Patent Application No. 9-249983, the slant recess 43 serves to set the holder 4 to a predetermined stamp making position in the stamp manufacturing device.

Since the slant recess 43 has both sides which are slanted to the inside of the holder 4, even if the positional relation between the positioning member of positioning mechanism in the stamp manufacturing device and the holder 4 is slightly deviated, the holder 4 is caused to move such that the positioning member properly mates with the center position of the slant recess 43 due to the cam effect generated between the positioning member of the positioning mechanism and the slant recess 43 of the holder 4. The holder 4 is then set to a predetermined stamp making position in the stamp manufacturing device. The number of the detection recesses 44 and their positions may be changed according to the size of the holder 4. The detection recesses 44 are used for specifying the type (size) of the holder 4 in cooperation with groove sensors such as microswitches disposed in the positioning mechanism of the stamp manufacturing device.

It is configured such that the positions of the slant recess 43 and the detection recess 44 formed on one wall surface of the peripheral wall 38 are in rotational symmetry with respect to the positions of the slant recess 43 and the detection recess 44 formed on another wall surface. This makes it possible to perform a stamp making process for the stamp material 3 even when the holder 4 is set by reversing the front and rear walls to the predetermined stamp making position in the positioning mechanism of the stamp manufacturing device.

At lower positions of the front and rear walls (long walls) of the peripheral wall 38, as shown in FIG. 8, a pair of lugs 45 serving as a stopper are formed. The lugs 45 can be fitted in stopper recesses 62 of a cap 60 which will be mentioned later to attach the cap 60 to a lower end of the lower holder portion 31. Accordingly, the stamp surface of the stamp material 3 held at the lower end of the peripheral wall 38 is covered and protected by the cap 60.

Figure 12:
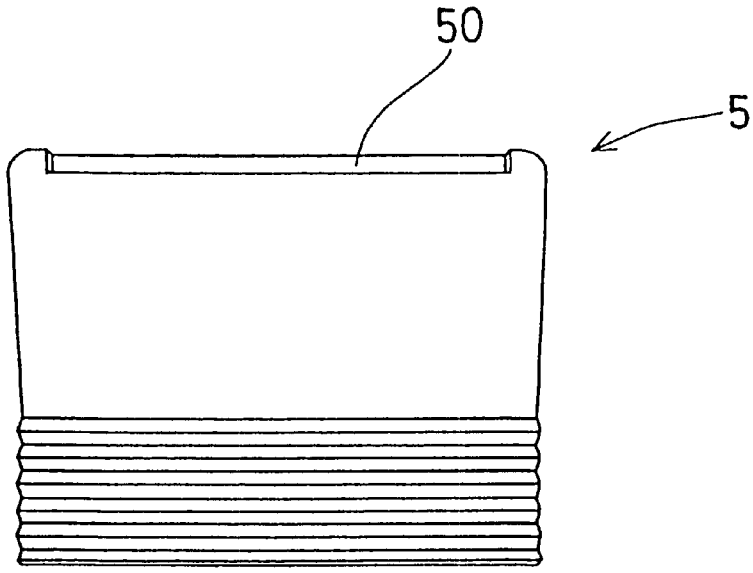
FIG. 12 is a side view of a grip member.

Next, the grip member 5 is described with reference to FIG. 12 to FIG. 14. FIG. 12 is a side view of the grip member 5, FIG. 13 is a bottom view of the grip member 5, and FIG. 14 is a cross sectional view of the grip member 5 taken in a shorter width direction.

In those drawings, the grip member 5 is provided, on its upper surface, with a labeling portion 50 to which a label and the like for indicating the content of the stamp surface formed on the material 3 is attached. Inside of the grip member 5, as shown in FIGS. 2, 13 and 14, there is provided a press portion 51 from the lower surface of the upper wall, the press portion 50 being inserted in the peripheral wall 32 of the upper holder portion 30 of the holder 4. The press portion 51 presses the ink pack 6 disposed in the holder 4 through the cardboard 37. The press portion 50 serves to depress the ink pack 6 arranged in the holder 4 through the cardboard 37.

Figure 13:
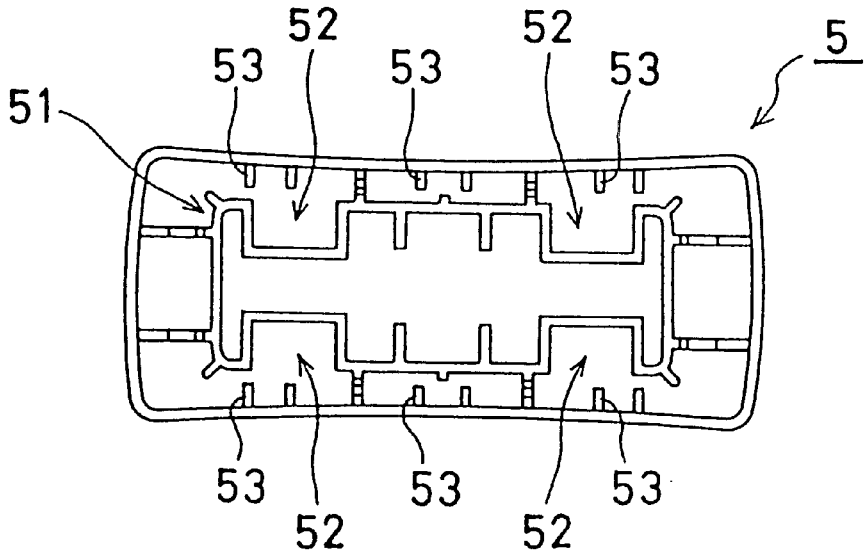
FIG. 13 is a bottom view of the grip member.
Figure 14:
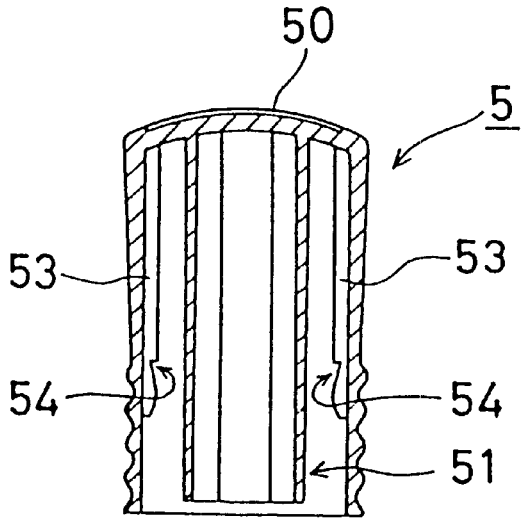
FIG. 14 is a cross sectional view of the grip member.

The press portion 51, of which the bottom is viewed in FIG. 13, has a substantially rectangular shape with four concave portions 52 disposed at the positions opposite to each other on both walls of the press portion 51. Each of the concave portions 52 is to allow the wall defining the ink supply hole 26 disposed on one wall surface of the peripheral wall 32 to be inserted when the press portion 51 of the grip member 5 is inserted in the peripheral wall 32 of the holder 4. The reason that two pairs of the concave portions 52 are formed is to prevent the wall defining the ink supply hole 26 from becoming an obstacle no matter how the press portion 51 of the grip member 5 is inserted in the peripheral wall 32. On the inner wall surface of the grip member 5, there are provided a plurality of ribs 53 (twelve ribs in FIG. 13) disposed extending in a vertical direction as shown in FIG. 14. In each of the ribs 53 disposed on the inner long side of the rectangle formed by the press portion 51, a rib groove 54 is integrally formed on a lower side of the rib 53. The rib groove 54 is to be fitted in the groove 33 formed on the peripheral wall 32 in the external upper part thereof, thereby integrally connecting the holder 4 to the grip member 5. In each of the ribs 53 disposed on the inner short side of the rectangle formed by the press portion 51, a cutout 55 is formed as shown in FIG. 3. The cutout 55 contacts with the upper end of the short side of the interior wall 11 which forms the rectangle open cavity 10 in the skirt member 2 when the holder 4 is moved downward in the skirt member 2 to an extent capable of stamping operation by the stamp material 3. Thus, the cutout 55 serves to restrict movement of the holder 4 within enough of a range for stamping operation.

Figure 15:
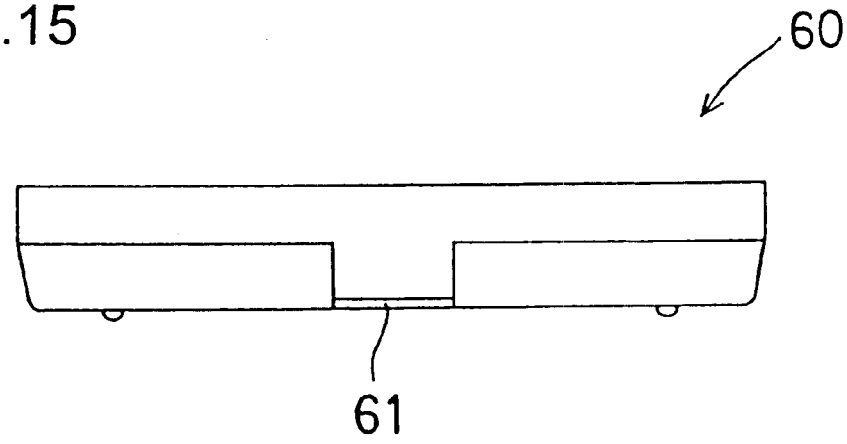
FIG. 15 is a side view of a cap member.
Figure 16:
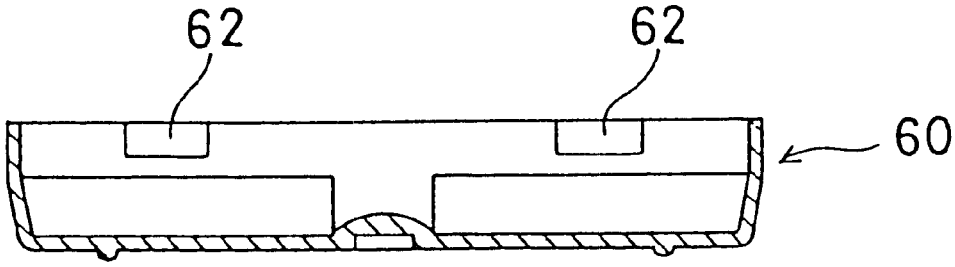
FIG. 16 is a cross sectional view of the cap member.

Next, description is made on a cap member to be attached to the lower end of the lower holder portion 31 of the holder 4, referring to FIGS. 15 and 16. FIG. 15 is a side view of the cap member and FIG. 16 is a cross sectional view of the cap member. The cap member 60 has an open box-like shape and is provided, at center positions on both outer side walls, with holding parts 61 which can be held by user's fingers for attachment or detachment of the cap 60 to or from the holder 4.

On the both inwall side surfaces of the cap 60, there are provided a pair of stopper recesses 62 with which the pair of the stopper lugs 45 formed on the peripheral wall 38 are to be engaged. By the engagement between the stopper recesses 62 of the cap 60 and the stopper lugs 45 of the peripheral wall 38, the cap member 60 is attached to the peripheral wall 38 of the holder 4. Therefore, the stamp surface of the stamp material 3 held inside the peripheral wall 38 of the holder 4 is covered and protected by the cap member 60.

In FIGS. 1 to 3, the stamp material 3 retained at the lower end of the holder 4 has, for example, a three-layered construction structured from: an upper layer 71 with 3 mm thickness made of porous hard resin such as vinylformal resin having pore ratio of about 90%; an intermediate layer 72 with 2 mm thickness made of porous hard resin same as that of the upper layer 71; and a lower layer 73 made of porous soft resin, in which optical energy absorbing substance such as carbon black is dispersed, such as urethane resin having pore ratio of about 65 %. The intermediate layer 72 and the lower layer 73 are mutually adhered by adhesive applied between both layers, and the upper layer 71 and the intermediate layer 72 are mutually free without adhesive.

Here, the lower layer 73 has pores therein with a mean diameter which is larger than 10 μm and smaller than 50 μm, the mean diameter being preferably within a range of 20±10 μm. And the ink included in the lower layer 73 has viscosity which is in a range of 300 to 2000 cps, preferably in a range of 500 to 1500 cps.

In the upper layer 71, a plurality of circular through holes 74 with 1 mm~2 mm diameter are formed. That is, supposed that both the upper layer 71 and the intermediate layer 72 construct one porous hard resin layer. Thus, there are formed in the porous hard resin layer recesses which do not reach to the lower layer 73. Thus, since the through holes 74 are formed in the upper layer 71 in the stamp material 3 having the three-layered construction, the ink supplied from the ink supply hole 24 and spread over the upper layer 71 rapidly reaches to the intermediate layer 72 through the through holes 74. Further, the ink reaching to the intermediate layer 72 is gradually absorbed therein and reaches to the lower layer 73. Therefore, even if the stamp material 3 has the three-layered construction and the total thickness of the porous hard resin layer is large, a time necessary for the ink to reach to the lower layer made of porous soft resin is substantially the same as a comparably short time in a case that the stamp material 3 has two-layered construction and the total thickness of the porous hard resin layer is small. Therefore, according to the stamp unit 1 of the first embodiment, it can reduce the time necessary for the ink to reach to the lower layer 73 after the ink pack 6 is opened. This means that the time necessary to start the stamping operation after the ink pack 6 is opened can be remarkably reduced while increasing ink quantity stored in the stamp material 3 to the extent that the stamping operation an be conducted.

In FIG. 2, the circumference of the lower layer 73 in the tamp material 3 and the lower end of the holder 4 are deformed y a heat-press process, thereby the circumference of the lower layer 73 is made in a slant surface and the lower end of the holder 4 is smashed by press so as to hang the circumference of the lower layer 73. Further, the circumference of the slant surface of the lower layer 73 in the stamp material 3 is sealed because pores in the circumference of the slant surface are sealed by heat or resin, thus ink does not leak therefrom. Therefore, the stamp surface is formed on the lower layer 73 of the stamp material 3 except for the circumference thereof.

Figure 17:
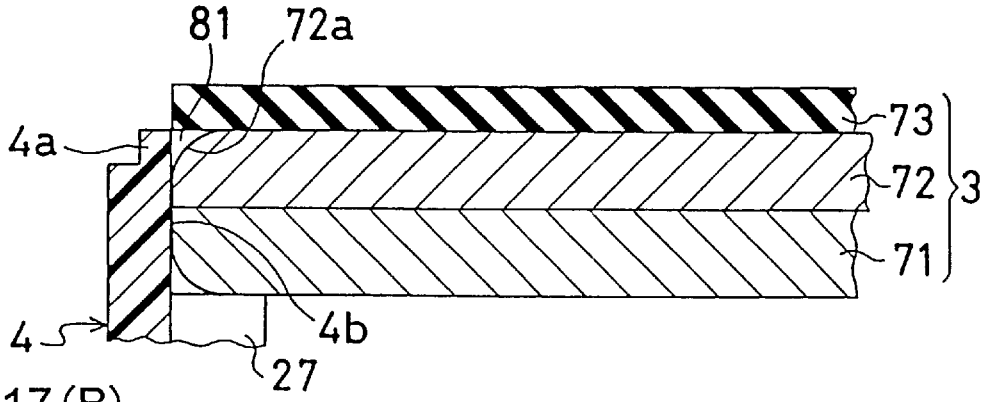
FIGS. 17(A), (B) and (C) are process views which schematically show a heat-press process between the holder and the stamp material and a melting process of an inclined surface of the stamp material.
Figure 17:
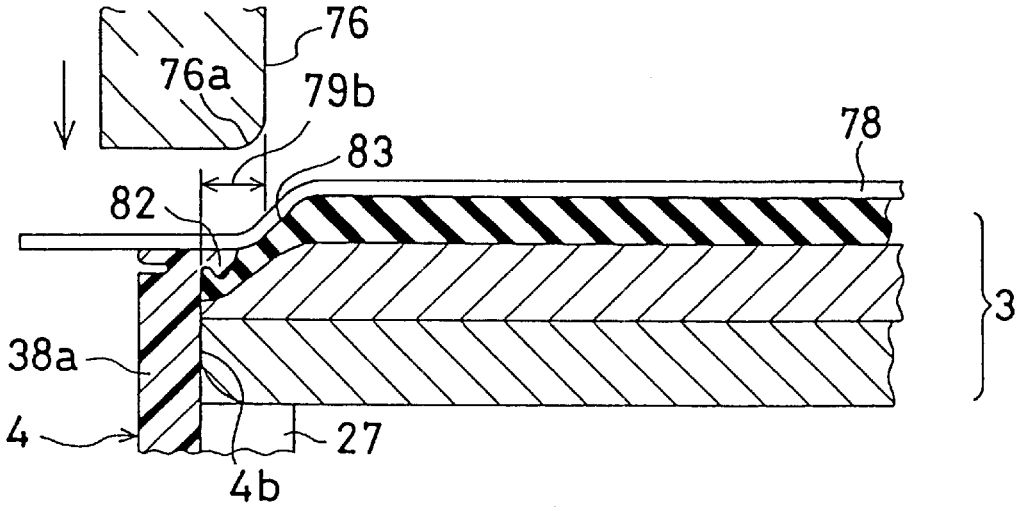
Figure 17:
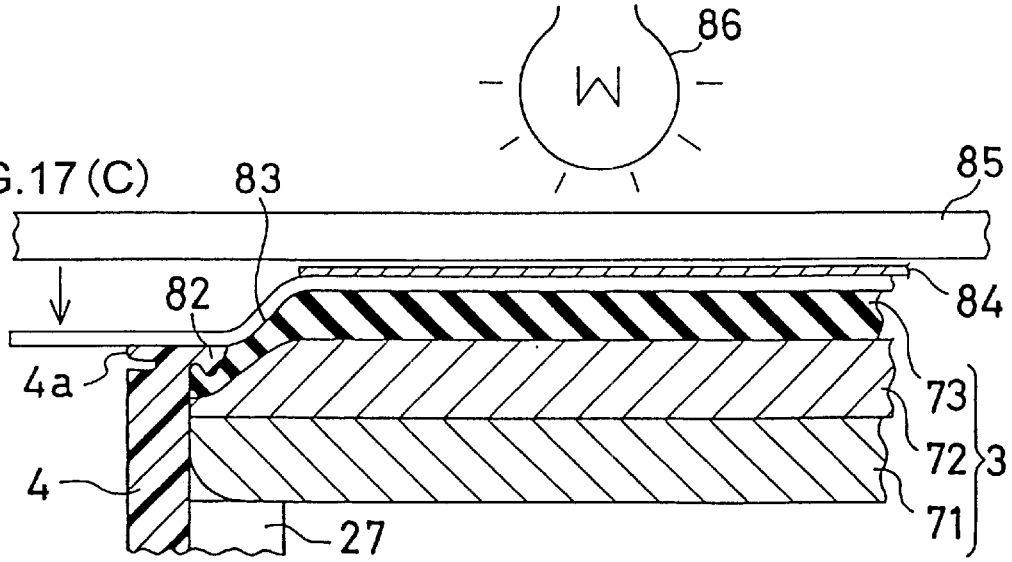
Figure 18:
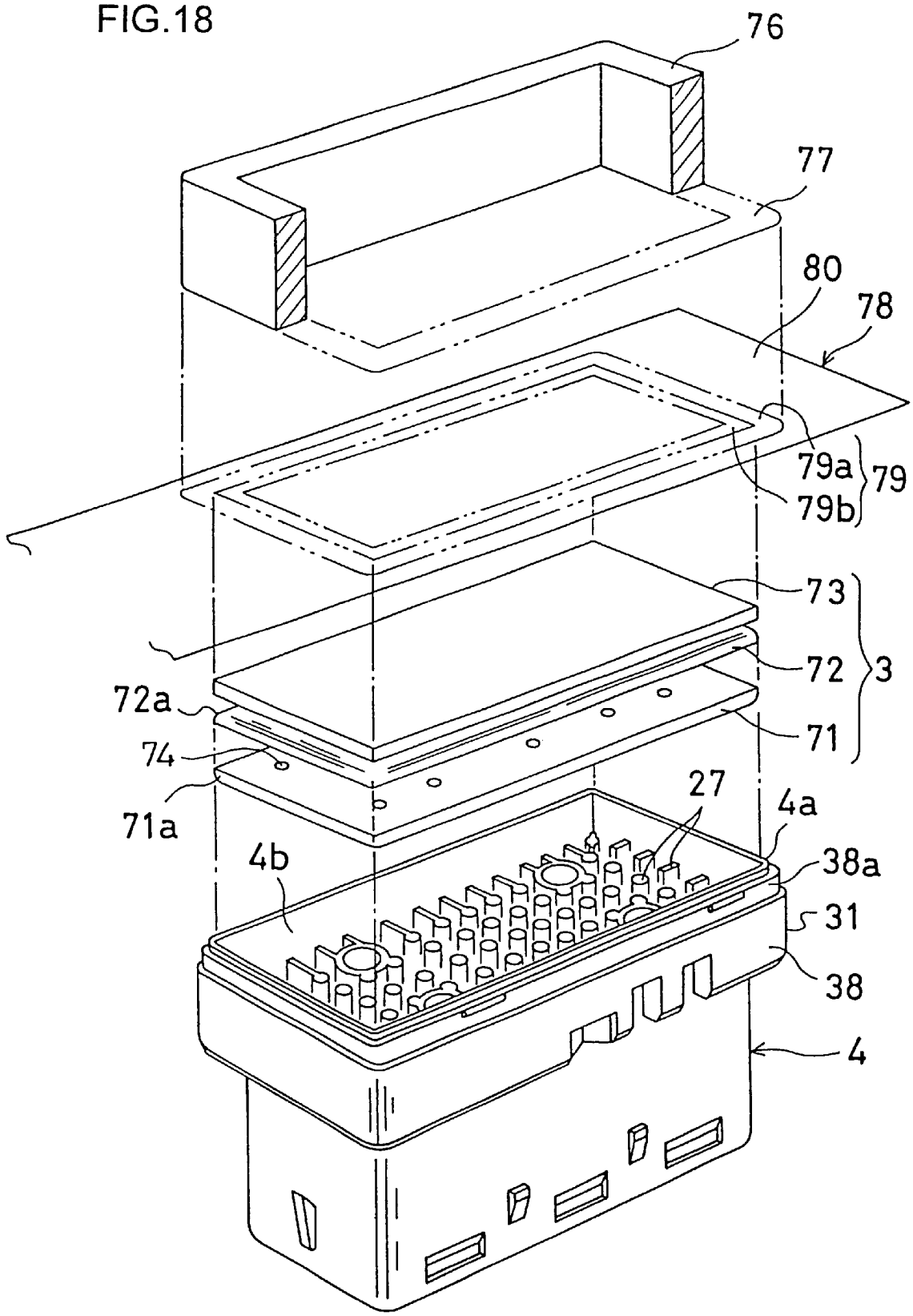
FIG. 18 is a schematic exploded perspective view which shows an assembling state of the holder and the stamp material in the heat-press process.
Figure 19:
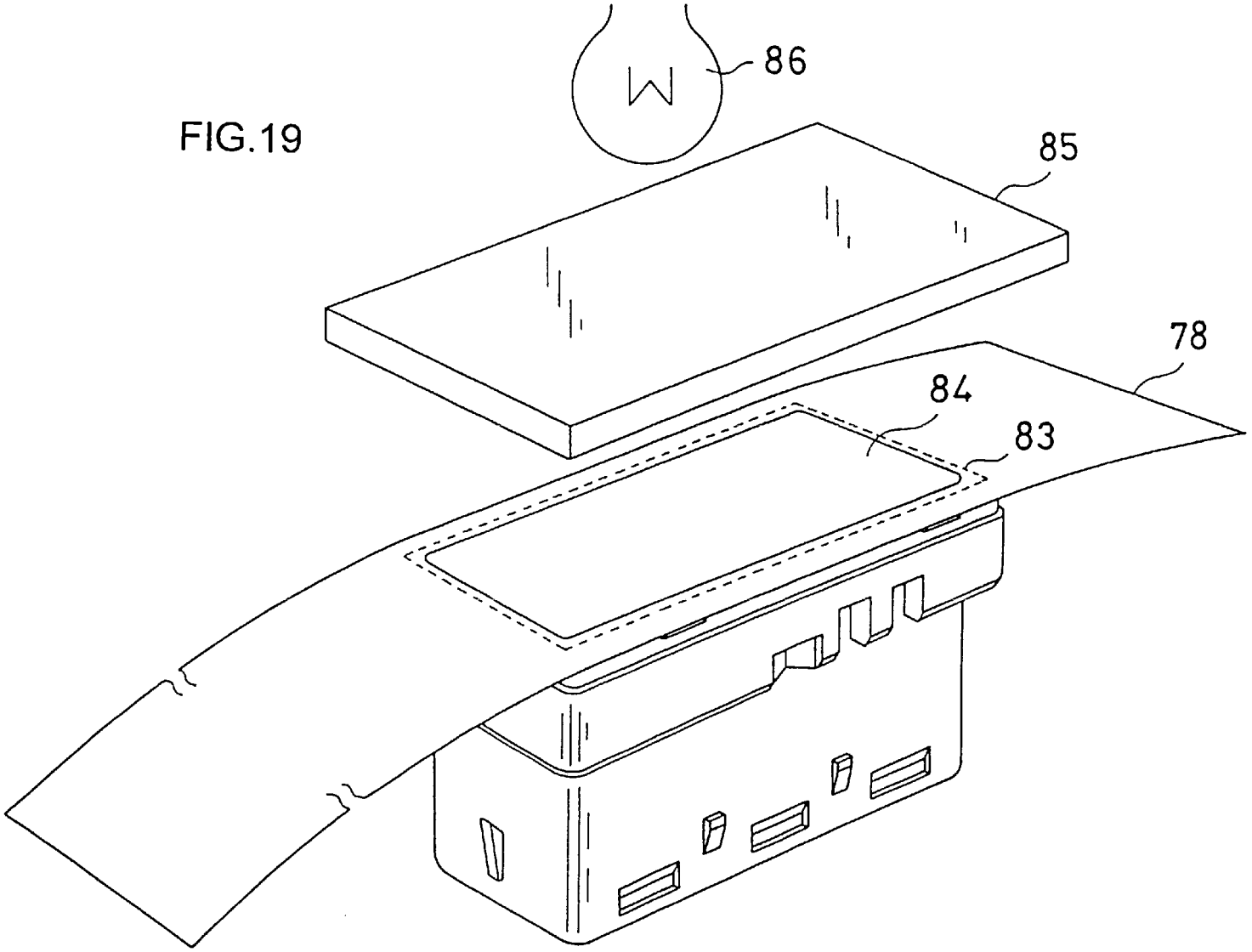
FIG. 19 is a perspective view which shows the melting process of the inclined surface of the stamp plate after the heat-press process.

Referring to FIGS. 17 to 19, it will be described in detail the heat-press process between the circumference of the lower layer 73 and the lower end of the holder 4. FIG. 17 is a process view which schematically shows a heat-press process between the holder 4 and the stamp material 3 and a melting process of a slant surface of the stamp material 3, FIG. 18 is a schematic view which shows an assembling state of the holder 4 and the stamp material 3 in the heat-press process, and FIG. 19 is a perspective view which shows the melting process of the slant surface of the stamp material 3 after the heat-press process.

In FIGS. 17(A) and (B), a heat-press jig 76 is formed in a rectangular cylindrical form according to a plan view thereof and controlled by a heat control device not shown. Here, heat temperature of the heat-press jig 76 to deform the stamp material 3 is set in a range of 200° C. to 240° C. The heat-press jig 76 has a heat-press area 77 according to its form as shown in FIG. 18.

A protect film 78 is constructed from a transparent resin film which is formed of resin such as PET (polyethylene terephthalate), PEN(polyethylene naphthalate), polyamide. A thin layer of silicon resin or fluoro resin is formed on the entire surface or partial surface corresponding to the heat-press area 77 of the heat-press jig 76 in the protect film 78, by conducting surface treatment of silicon resin or fluoro resin. The melting point of resin component forming the protect film 78 is prepared to a temperature which is lower than the heat temperature of the heat-press jig 76 and higher than the melting point of resin component included in the holder 4 and the stamp material 3. On the protect film 78, a heat-press portion 79 is formed corresponding to the heat-press area 77 of the heat-press jig 76. The heat-press portion 79 is divided into two heat-press portions 79*a*, 79*b*. The outer heat-press portion 79*a* corresponds to a welding portion where the lower layer 73 of the stamp material 3 and the inner side of lower end 4*a* of the holder 4 are mutually welded, and the inner heat-press portion 79*b* corresponds to a width of the lower end 4*a* in the holder 4 after welded. Further, the protect film 78 has a holding portion 80 outside of the heat-press portion 79.

In FIGS. 17(A)–(C), the stamp material 3 is shown in a reverse relation of up and down, thus the lower layer 73, the intermediate layer 72 and the upper layer 71 are shown in this order from the upper side. As mentioned above, the lower layer 73 is made of porous soft resin, in which optical energy absorbing substance such as carbon black is dispersed, such as urethane resin having pore ratio of about 65%, the intermediate layer 72 and the upper layer 71 are made of porous hard resin such as vinylformal resin having pore ratio of about 90%. Further, like the stamp material 3, the holder 4 is shown in a reverse relation of up and down (different from a case of stamping operation) and the lower holder portion 31 is arranged upward, thus the lower end 4*a* is arranged upward. The upper layer 71 is pressed into an inner space 4*b* surrounded by the lower end 4*a* until the upper layer 71 contacts with the support posts 27. A spherical slant surface 71*a* formed on a circumference edge of the upper layer 71 faces the support posts 27, that is, for the side from which ink is supplied.

Further, the intermediate layer 72 is pressed into the inner space 4*b* until the intermediate layer 72 contacts with the upper layer 71. A spherical slant surface 72*a* formed on a circumference edge of the intermediate layer 72 faces the lower layer 73 so as to oppose each other. The circumference of the lower layer 73 is formed into a plate-like flat form and adhered to the intermediate layer 72 through adhesive applied on the intermediate layer 72 with dot form.

The lower end 4*a* of the holder 4 is made thinner than the end 38*a* of the peripheral wall 38 formed in the lower holder portion 31. But, the side of the inner space 4*b* is continuously formed therethrough. The thickness of the lower end 4*a* is set so as to become equal to the thickness of the end 38*a* when the lower end 4*a* is heat-pressed and deformed.

The heat-press process is described hereinafter. To conduct the heat-press process between the lower end 4*a* of the holder 4 and the circumference of the stamp material 3, at first, the upper layer 71, the intermediate layer 72 and the lower layer 73 forming the stamp material 3 are arranged in the inner space 4*b* of the holder 4, as shown in FIG. 17(A). At this time, the lower layer 73 is entirely projected and exposed from the lower end 4*a* of the holder 4. There may be no problem if the lower layer 73 is partially inserted in the inner space 4*b* of the holder 4. In this state, the spherical slant surface 72*a* of the intermediate layer 72 opposes the lower layer 73 and a space 81 is formed therebetween. This space 81 is used for a space in which the circumference of the lower layer 73 flows when the circumference of the lower layer 73 is deformed by the heat-press process.

Thereafter, as shown in FIG. 17(B), the protect film 78 is put on so as to cover the stamp surface on the lower layer 73 of the stamp material 3. Retaining this state, the heat-press jig 76 heated to the predetermined temperature is moved downward and retained to a pressing state for a predetermined time (1 to 5 seconds, preferably 3 seconds). Thereby, the circumference of the lower layer 73 flows into the space 81 and the lower end 4*a* of the holder 4 is deformed as shown in FIG. 17(B). Here, since the wall of the inner space 4*b* of the holder 4 is formed straightly, the lower end 4*a* can be easily deformed toward the inner space 4*b*. Therefore, the lower end 4*a* encroaches into the deformed circumference of the lower layer 73 and forms a hook-like wedge 82, as shown in FIG. 17(B). This wedge 82 serves to hook the circumference of the lower layer 73 while holding the contact state between the lower end 4*a* and the circumference of the lower layer 73 so as to seal. The portion of the lower layer 73 opposite to the wedge 82 of the lower end 4*a* is deformed so as to adhere to the end 38*a* of the peripheral wall 38.

IS By the heat-press process, a slant surface 83 of the circumference of the stamp material 3 is formed, because the lower end 4*a* of the holder 4 and the circumference of the lower layer 73 are deformed. To accomplish this, the heat-press jig 76 is constructed so as to have a spherical slant surface 76*a* at the inner side thereof, corresponding to the inner heat-press portion 79*b* of the protect film 78. Since the protect film 78 exists between the lower layer 73 and the heat-press jig 76 when heat-press process is conducted, the slant surface 83 of the circumference in the stamp material 3 becomes a smooth slant surface without difference in level. At the same time, the protect film 78 is welded to a flat portion of the deformed lower end 4*a* in the holder 4, in a condition that the protect film 78 can be peeled off. As mentioned, the stamp material 3, the holder 4 and the protect film 78 are heat-pressed by the heat-press jig 76 at the same time.

As explained above, the lower end 4*a* of the holder 4 and the lower layer 73 of the stamp material 3 are mutually hooked by the wedge 82 while holding the contact state between the lower end 4*a* and the circumference of the lower layer 73 so as to seal, therefore it can surely seal the lower layer 73 and the lower end 4*a*. As a result, ink leaks between the stamp material 3 and the holder 4 can be prevented. In order to efficiently conduct the heat-press process, it is effective to: ① make the lower end 4*a* thin and form the inner side thereof straight; ② form spherical slant surface 72*a* in the circumference of the intermediate layer 72; and ③ form the support posts 27 to support the circumference of the stamp material 3.

Since the lower end 4*a* of the holder 4 is deformed so as to have the wedge 82 which hooks the circumference of the lower layer 73, it can retain the seal state between the lower end 4*a* of the holder 4 and the circumference of the lower layer 73, even after many stamping operations are repeated. Therefore, seal ability between the holder 4 and the stamp material 3 can be remarkably improved.

Here, since the holder 4, the stamp material 3 and the protect film 78 includes resin component and the melting point of the resin component included in the protect film 78 is set higher than the resin component included in both the holder 4 and the stamp material 3, the resin component of the protect film 78 is not firmly heat-pressed to the lower end 4*a* of the holder 4 due to high melting point. Thus, the protect film 78 can be easily peeled off from the holder 4 when stamping operation is conducted. Further, on the surface of the protect film 78 opposing to the heat-press jig 76, the resin layer formed of silicon resin or fluoro resin is formed, therefore it can prevent the protect film 78 from firmly adhering to the heat-press jig 76 while heat-press process. In particular, the resin layer of silicon resin or fluoro resin effectively acts when heat-press process is conducted at a temperature near to the melting point of the protect film 78.

Subsequently, a process to selectively melt and solidify the slant surface 83 of the stamp material 3 is done by emitting light from light emission tube. At this time, the protect film 78 is constructed from a transparent resin film. As shown in FIG. 19, at first, a mask 84 made of aluminum foil or silver foil is put on the protect film 78. This mask 84 has a size capable of covering the area for making the stamp surface and exposing the area corresponding to the slant surface 83 of the stamp material 3 (shown by dot line in FIG. 19). Further, a transparent glass plate 85 is put on the mask 84 and is pressed by a press device not shown. Thereafter, a light emission tube 86 such as xenon tube is driven to emit light. Here, since the mask 84 does not exist in an area corresponding to the slant surface 83 formed in the lower layer 73, light emitted from the light emission tube 86 is irradiated to the slant surface 83. According to this, the optical energy absorbing substance such as carbon black dispersed in the lower layer 73 absorbs light from the light emission tube 86 and is heated. Thus, resin component in the lower layer 73 is melted and then solidified, thereby continuous pores existing in the lower layer 73 are smashed. As a result, the slant surface 83 of the stamp material 3 is melted and solidified and it can prevent ink from leaking from the slant surface 83. In case that the mask 84 is made thin, there will be no difference in level in a boundary portion of the melted and solidified portion and the other portion on the lower layer 73, even if the light emission tube 86 is driven to emit light in a condition where the stamp material 3 is deformed by pressing the glass plate 85 thereto, thereafter the stamp material 3 is expanded in the original state.

By the way, since an image printed on the positive manuscript is heated when the stamp surface is formed on the stamp material 3, there is fear that the positive manuscript adheres to the protect film 78. However, the resin layer formed of silicon resin or fluoro resin is formed on the surface of the protect film 78, therefore the protect film 78 does not adhere to the positive manuscript. Further, since holding portion 80, which is held when the protect film 78 is peeled off from lower end 4*a* of the holder 4, is formed with the protect film 78 outside of the heat-press portion 79, the protect film 78 can be easily and simply peeled off from the holder 4.

The process to melt and solidify the circumference of stamp material 3 may be done before the heat-press process that the lower end 4*a* of the holder 4 and the circumference of the stamp material 3 are heat-pressed. In this case, at first, a flat heat-press jig is contacted to the circumference of the lower layer 73, thereby the circumference of the lower layer 73 is melted and solidified and the continuous pores existing in the circumference of the lower layer 73 are smashed. Thereafter, the heat-press process is conducted on the lower layer 73 as shown in FIGS. 17(A), 17(B). At this time, since the circumference of the lower layer 73 is already hardened, it may occur that the circumference of the lower layer 73 is hard to deform in the heat-press process showing in FIG. 17(A), 17(B). Therefore, it will be preferable that the process for melting and solidifying is conducted after the heat-press process as shown in FIGS. 17(C).

Further, the process for melting and solidifying can be done by the heat-press jig different from the method shown in FIG. 17(C). In this case, the heat-press jig having a form according to the slant surface 83 of the circumference in the stamp material 3 is pressed to the slant surface 83, thereby the circumference of the lower layer 73 can be melted and solidified and the continuous pores in the circumference can be smashed. But, in this case, since difference in level between the pressed portion and non-pressed portion will occur when the heat-press jig is pressed to the lower layer 73, it is preferable that the process for melting and solidifying is done according to the method using the mask and the light emission tube shown in FIG. 17(C).

The process for producing the stamp unit 1 mentioned above is as follows. At first, to make a stamp surface in the underside of the stamp material 3, the holder 4 is set to the predetermined position in the holder storage part of the stamp manufacturing device (not shown). Based on the cam effect between the slant surfaces of the slant recess 43 of the lower holder portion 31 and the positioning projection arranged in the positioning mechanism, the holder 4 is allowed to be positioned at a predetermined stamp making position. In this position, the size of the holder 4 is detected in cooperation with the detection recesses 44 and the recess sensors arranged in the positioning mechanism.

In the stamp manufacturing device, a part of rolled-up transparent film is drawn out and fed from the roll, and characters and figures are printed on the film through the thermal head and the thermal ribbon, thereby a positive manuscript is formed. This positive manuscript is fed onto a transparent acrylic plate. At this time, the holder 4 is set to a predetermined stamp making position such that the lower layer 73 of the stamp material 3 is opposite to the manuscript while existing the transparent acrylic plate between the lower layer 73 of the stamp material 3 and the positive manuscript. In this state, when a xenon tube disposed below the transparent acrylic plate is driven to emit light, the lower layer 73 of the stamp material 3 is irradiated with the light through the positive manuscript. As a result, only the part of the lower layer irradiated with light at sites corresponding to the transparent portion of the manuscript is fused due to heating effect of the optical absorbing substance in the lower layer, and solidified. On the other hand, the part of the lower layer 73 corresponding to the characters and the like on the manuscript is not fused-solidified and remains as it is, thus forming a stamp surface on the underside of the stamp material 3.

Next, the procedure to assemble the stamp unit 1 will be described hereinafter after the stamp surface is formed on the stamp material 3. Upon completion of the stamp surface making of the stamp material 3, the holder 4 is inserted in the open cavity 10 of the skirt member 2 under the condition that, on each side surface of the upper skirt portion 13, the coiled portion of the spring 16 is previously positioned around the positioning projection 18 while the one end of the spring 16 is fixedly inserted in the stopper 17. The sloped projection 35 formed on each side surface of the peripheral wall 32 of the upper holder portion 30 of the holder 4 inserted from the lower open end of the skirt member 2 is allowed to slide upward in the vertical slot 19. When the sloped projection 35 goes over the other end of the torsion spring 16 according to the wedge shape of the projection 35, the end of the torsion spring 16 is stopped in contact with the lower end of the projection 35. The holder 4 in this position is urged upward in the skirt member 2 by the urging force of the torsion spring 16, while the holder 4 is also slidable downward against the urging force of the spring 16.

Figure 20:
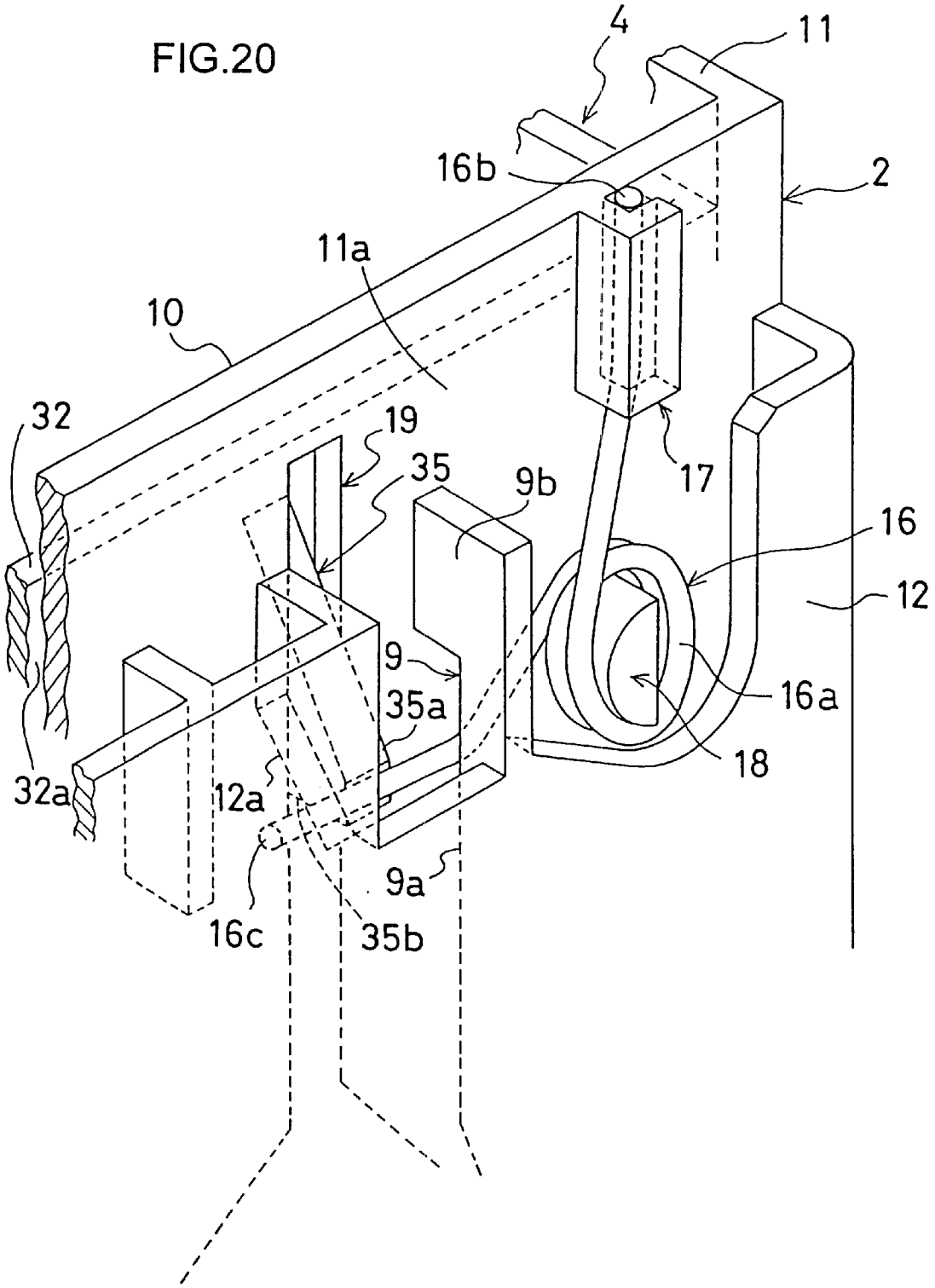
FIG. 20 is a partially enlarged perspective view to explain a state that the holder is inserted in the skirt member from a lower part of the skirt member.

Here, with reference to FIGS. 20, 21, it will be explained in detail the construction that the holder 4 is slidably retained in the skirt member 2 while being urged upward by inserting the holder 4 within the skirt member 2 from the lower side thereof.

As mentioned above, the skirt member 2 has the open cavity 10 surrounded by the interior wall 11 having a substantially rectangular shape. The outer short sides in the rectangular open cavity 10 constructs a pair of first wall parts 11*a*. And the outer short sides in the rectangular peripheral wall 32 of the holder 4 constructs a pair of second wall parts 32*a*.

On the first wall part 11*a* of the skirt member 2, there is provided the spring stopper 17, the semicircular positioning projection 18, the spring limit member 9 to limit the torsion spring 16 and the vertical slot 19. The positioning projection 18 retains the coiled part 16*a* of the torsion spring 16 in a cantilever manner so that the coiled part 16*a* does not deviate from the projection 18. The spring stopper 17 engages one end 16*b* of the torsion spring 16. Between the first wall part 11*a* and the exterior wall 12, a engaging part 12*a* is formed, the engaging part 12*a* having a slope the same as that of the sloped projection 35 and determining the upper position of the other end 16*c* of the torsion spring 16. By using the engaging part 12*a*, the other end 16*c* of the torsion spring 16 can be previously attached to the skirt member 2 while being urged upward. The vertical slot 19 having an opened lower end guides the sloped projection 35 in an up and down direction. The spring limit member 9 is constructed from a guide rail 9*a* which is projected toward the first wall part 11*a* from the exterior wall 12, the spring limit member 9 restricting an intermediate part between the coiled part 16*a* and the other end 16*c* of the torsion spring 16 so as not to move and deviate outward. The guide rail 9*a* is formed along the vertical slot 19 with a predetermined distance therebetween. The upper end of the guide rail 9*a* is formed in a connecting part 9*b* which is continuously connected to the first wall part 11*a*. Here, the connecting part 9*b* may be opened at its upper end. Further, though the spring limit member 9 is formed on the first wall part 11*a* between the interior wall 11 and the exterior wall 12, the spring limit member 9 may be formed in a hook shape which projects from the first wall part 11*a* and stops the other end 16*c* of the torsion spring 16.

The sloped projection 35, which is formed on the second wall part 32*a*, acts as a limit member against the other end 16*c*. The sloped projection 35 is formed in a wedge shape slanted outward and downward. As shown in FIG. 20, when the holder 4 is inserted in the skirt member 2 from the lower part thereof, a slant portion 35*a* of the sloped projection 35 pushes the other end 16*c* of the torsion spring 16 outward. At this time, the intermediate part between the other end 16*c* and the coiled part 16*a* is restricted by the guide rail 9*a* of the spring limit member 9. Therefore, a part between the other end 16*c* and the intermediate part deforms outward because the intermediate part is restricted by the guide rail 9*a* of the spring limit member 9, and the coiled part 16*a* is pressed inward. When the other end 16*c* of the torsion spring 16 goes over the sloped projection 35, the other end 16*c* is guided by the slope of the engaging part 12*a*. Thus, the other end 16*c* is positioned from the inner side of the first wall part 11*a* and engaged with the lower end 35*b* of the sloped projection 35. At this time, the other end 16*c* of the torsion spring 16 entirely urges the holder 4 upward through the sloped projection 35 and slidably retains the holder 4 in the direction of up and down in the skirt member 2. The upper limit position of the holder 4 in the skirt member 2 is determined due to the fact that a step part 31*a* of the holder 4 contacts with a lower side of a step part 14*a* of the skirt member 2 as shown in FIG. 1.

The torsion springs 16 are arranged on both the short sides where the skirt member 2 and the holder 4 oppose each other. More than two torsion springs 16 may be arranged on both the long sides where the skirt member 2 and the holder 4 oppose each other, in addition to the short sides.

In a case that length difference between the short side and the long side of the open cavity 10 is small, that is, the open cavity 10 is formed in a substantial square shape with short length, the torsion spring 16 may be arranged on one of the short side and the long side. In this case, the number of members can be reduced, and the space for the ink pack 6 can be enlarged because of small space for the torsion spring 16 and stamping operation can be increased because of increase of ink quantity stored in the space. Further, though it is preferable to use the torsion spring 16, a rod-like spring may be utilized.

Figure 21A:
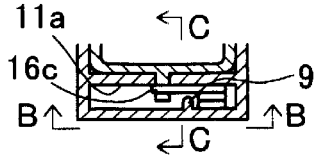
FIG. 21(A) is a partial top view in section of the holder being inserted into the skirt member at an initial stage of insertion.
Figure 21B:
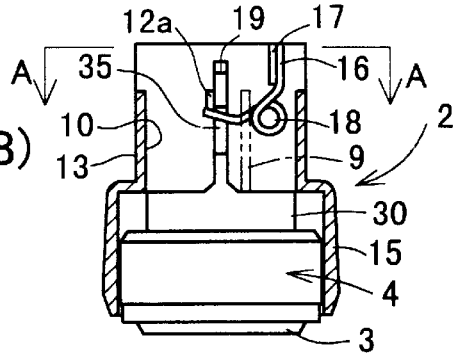
FIG. 21(B) is a front view in partial section of the holder being inserted into the skirt member at an initial stage of insertion.
Figure 21C:
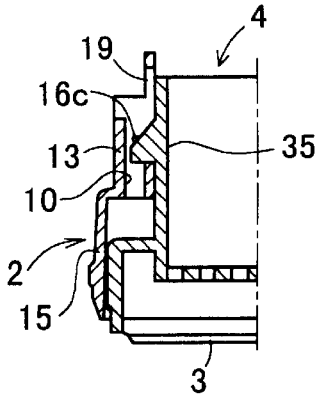
FIG. 21(C) is a partial side view in section of the holder being inserted into the skirt member at an initial stage of insertion.
Figure 21D:
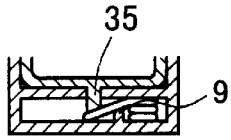
FIG. 21(D) is a partial top view in section of the holder being inserted into the skirt member at a final stage of insertion.
Figure 21E:
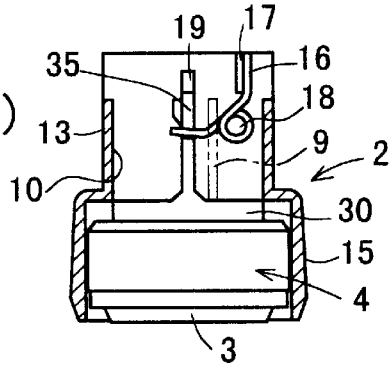
FIG. 21(E) is a front view in partial section of the holder being inserted into the skirt member at a final stage of insertion.
Figure 21F:
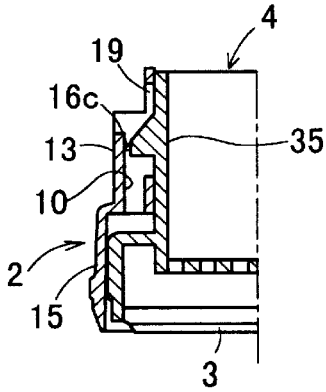
FIG. 21(F) is a partial side view in section of the holder being inserted into the skirt member at a final stage of insertion.
Figure 21G:
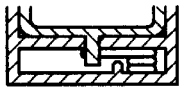
FIG. 21(G) is a partial top view in section of the holder inserted into the skirt member.
Figure 21H:
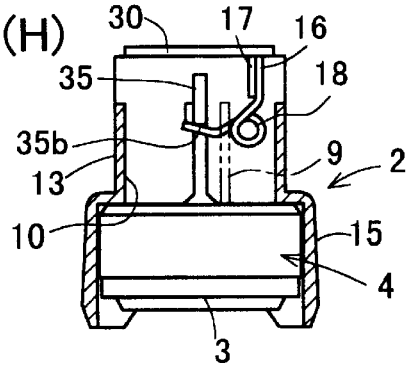
FIG. 21(H) is a front view in partial section of the holder inserted into the skirt member.
Figure 21I:
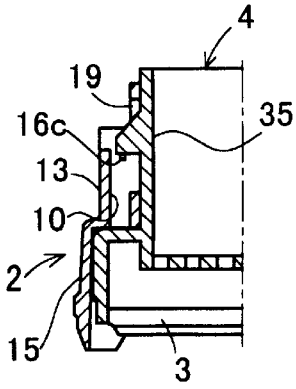
FIG. 21(I) is a partial side view in section of the holder inserted into the skirt member.

FIGS. 21(A)–(I) show by stages a state that the holder 4 is inserted in the skirt member 2 from the lower part thereof after the stamp surface is formed on the lower side of the stamp material 3 retained in the holder 4. Especially, FIGS. 21(A)–(C) show a state of inserting in early stage, FIGS. 21(D)–(F) show a state of inserting in substantially final stage, and FIGS. 21(G)–(I) show a state that inserting of the holder 4 in the skirt member 2 is completed. In FIGS. 21(B), (E) and (H), the front view corresponds to a partially sectional view representing such that the wall of the holder 4 can be seen. In FIGS. 21(A), (D) and (G), the upper view corresponds to a sectional plan view representing end parts of both the holder 4 and the skirt member 2. In FIGS. 21(C), (F) and (I), the right side view corresponds to a longitudinally sectional view representing only the left side of the holder 4 and the skirt member 2.

In FIGS. 21(A)–(C), the holder 4 is inserted in the open cavity 10 of the skirt member 2 from the lower part, the skirt member 2 being set in a state that the coiled part 16*a* of the torsion spring 16 is positioned by the positioning projection 18 on each of both sides of the upper skirt portion 13 and the one end 16*b* of the torsion spring 16 is engaged in the spring stopper 17. As shown in the upper view of FIG. 21(A), the other end 16*c* of the torsion spring 16 is positioned at the side of the first wall part 11*a* and separated from the spring limit member 9. Further, as shown in the right view of FIG. 21(C), the other end 16*c* of the torsion spring 16 is in a state right before being pressed outward by the slope of the sloped projection 35.

When the holder 4 is further inserted from the state shown in FIGS. 21(A)–(C), the sloped projection 35, which is formed on both side of the peripheral wall 32 of the upper holder portion 30 in the holder 4, is slid upward in the vertical slot 19 from the open end thereof, as shown in FIGS. 21(D)–(F). At this time, the part between the intermediate part and the other end 16*c* of the torsion spring 16 is deformed outward as mentioned. However, it can understandable that the intermediate part is restricted by the spring limit member 9 so as not to come off. As shown in the right view of FIG. 21(F), the other end 16*c* of the torsion spring 16 is in a state that the other end 16*c* runs along the slant portion 35*a* of the sloped projection 35 and positions at the top of the sloped projection 35.

As shown in FIGS. 21(G)–(I), the other end 16*c* of the torsion spring 16 is engaged in the lower end of the sloped projection 35 at the time that the sloped projection 35 goes over the other end 16*c* according to the wedge shape of the projection 35. In this state, the holder 4 is urged upward in the skirt member 2 by urging force of the torsion spring 16 and is slidable in the up and down direction against the urging force.

As explained in detail, the holder 4 can be easily inserted in the skirt member 2, thereby the holder 4 can be slidably retained in the skirt member 2. When inserting the holder 4 in the skirt member 2, the coiled part 16*a* of the torsion spring 16 is prevented from coming off from the positioning projection 18 by the guide rail 9*a* of the spring limit member 9, thus it is not necessary to carefully insert the holder 4 in the skirt member 2 so that the torsion spring 16 does not come off. Since the arranging space necessary for the torsion spring 16 with the coiled part 16*a* is small, the torsion spring 16 can be compactly arranged between the first wall part 11*a* of the skirt member 2 and the spring stopper 17 based on that the coiled part 16*a* is retained by the positioning projection 18 which is formed on the first wall part 11*a* of the skirt member 2. Further, the coiled part 16*a* of the torsion spring 16 retained to the positioning projection 18 in cantilever shape can be restricted so as not to come off from the positioning projection 18 by the spring limit member 9. Since the spring limit member 9 is formed along the vertical slot 19 formed on the first wall part 11*a* in the skirt member 2, the part between the intermediate part and the other end 16*c* of the torsion spring 16 is restricted by the spring limit member 9 when the sloped projection 35 presses and moves the other end 16*c* outward while inserting the holder 4 in the skirt member 2. Therefore, the holder 4 can be rapidly inserted in the skirt member 2 and it can judge that insertion of the holder 4 in the skirt member 2 is completed by hearing a sound occurring when the other end 16*c* is engaged in the lower end 35*b* of the sloped projection 35.

After assembly of the holder 4 to the skirt member 2 as mentioned above, the ink pack 6 is set in the storage area 22 and the cardboard 37 is arranged on the ink pack 6. Thereafter, the grip member 5 is attached to the holder 4 such that the press portion 51 is inserted in the peripheral wall 32 of the holder 4. This assembled state is shown in FIG. 2.

When the grip 5 in the state that the press portion 51 is inserted in the peripheral wall 32 is further pressed down, the ink pack 6 in the holder 4 is sandwiched and pressed between the cardboard 37 and the cutting rib 25. At this time, due to the action of the cardboard 37, the pressing force substantially uniformly exerts on the ink pack 6. The ink pack 6 is then broken at the portion contacting the cutting rib 25 and opened at the substantial center portion corresponding to the position of the cutting rib 25. The ink flowing out from the ink pack 6 can be dispersed uniformly around the rib 25. The cardboard 37 having the ink absorption ability absorbs the ink escaping from the opened ink pack 6 to the upper side when the ink pack 6 in the holder 4 is opened by the down movement of the grip member 5, thereby to prevent the leakage of the ink to the outside of the stamp unit 1. This state is shown in FIG. 3.

Because the space provided between the peripheral wall 32 and the cutting rib 25 becomes an ink storing portion for the ink escaping from the opened ink pack 6 as shown in FIG. 3, the ink is prevented from leaking to the outside of the holder 4 even if the ink escapes all at once from the ink pack 6 opened with the cutting rib 25.

The ink escaping from the ink pack 6 is guided downward through the ink supply hole 24 formed around the cutting rib 25, and then temporarily stored above the stamp material 3 as shown in FIG. 3. However, the ink is rapidly saturated into the stamp material 3 due to the action of the through holes 74 formed in the upper layer 71. Since the ink supply hole 24 is disposed around the cutting rib 25 and the support posts 27, separated each of which is mutually separated are formed under the ink supply hole 24, the ink escaping from the ink pack 6 is dispersed uniformly over the entire bottom of the holder 4, resulting in the uniform saturation of the stamp material 3 with ink.

When the ink pack 6 is opened by the downward movement of the grip member 5 in the above-mentioned manner, the cutout 54 formed in the lower side of each of the ribs 53 of the grip member 5 is engaged with the groove 33 formed on the peripheral wall 32 of the holder 4, so that the holder 4 is integrally connected to the grip member 5. As the grip member 5 and the holder 4 are integrally moved, therefore, the stamping operation is performed to stamp characters and the like corresponding to the stamp surface formed on the stamp material 3 saturated with ink as above. If stamping operation is repeated in many times, it can prevent the ink from leaking from the circumference of the stamp material 3 since the circumference of the stamp material 3 is perfectly sealed as shown in FIG. 17.

In the case that the ink saturated in the stamp material 3 decreases, disabling stamping with proper ink thickness, the following operation is carried out: the grip member 5 is detached from the holder 4, the cardboard 37 and the ink pack 6 with no ink are taken out from the holder 4, the ink-filled new pack 6 is inserted in the holder 4, and the grip member 5 is attached again to the holder 4 as mentioned above. Thus, the stamp operation is enabled again. Without taking out the ink pack 6 and the cardboard 37, alternatively, the ink supply may be performed through the ink supply hole 26 formed on an inwall surface of the peripheral wall 32 of the holder 4 in order to enable the stamping operation again.

Next, a stamp unit according to the second embodiment will be described hereinafter with reference to FIGS. 22 to 24. Here, since the stamp unit of the second embodiment has substantially the same structure as that of the stamp unit 1 of the first embodiment, explanation of the second embodiment will be done using the same numerals in the first embodiment.

As shown in FIG. 2, similarly to the first embodiment, the circumference of the lower layer 73 in the stamp material 3 and the lower end of the holder 4 are deformed by heat-press process, thereby the circumference of the lower layer 73 is made in a slant surface and the lower end of the holder 4 is sealed by pressing so as to hook the circumference of the lower layer 73. Further, the circumference of the slant surface of the lower layer 73 in the stamp material 3 is sealed due to the fact that pores in the circumference of the slant surface are sealed by sealant 90, thus ink does not leak therefrom. Therefore, the stamp surface which functions as an effective stamp area 91 is formed on the lower layer 73 of the stamp material 3 except for the circumference thereof on which the sealant 90 is applied.

Figure 22:
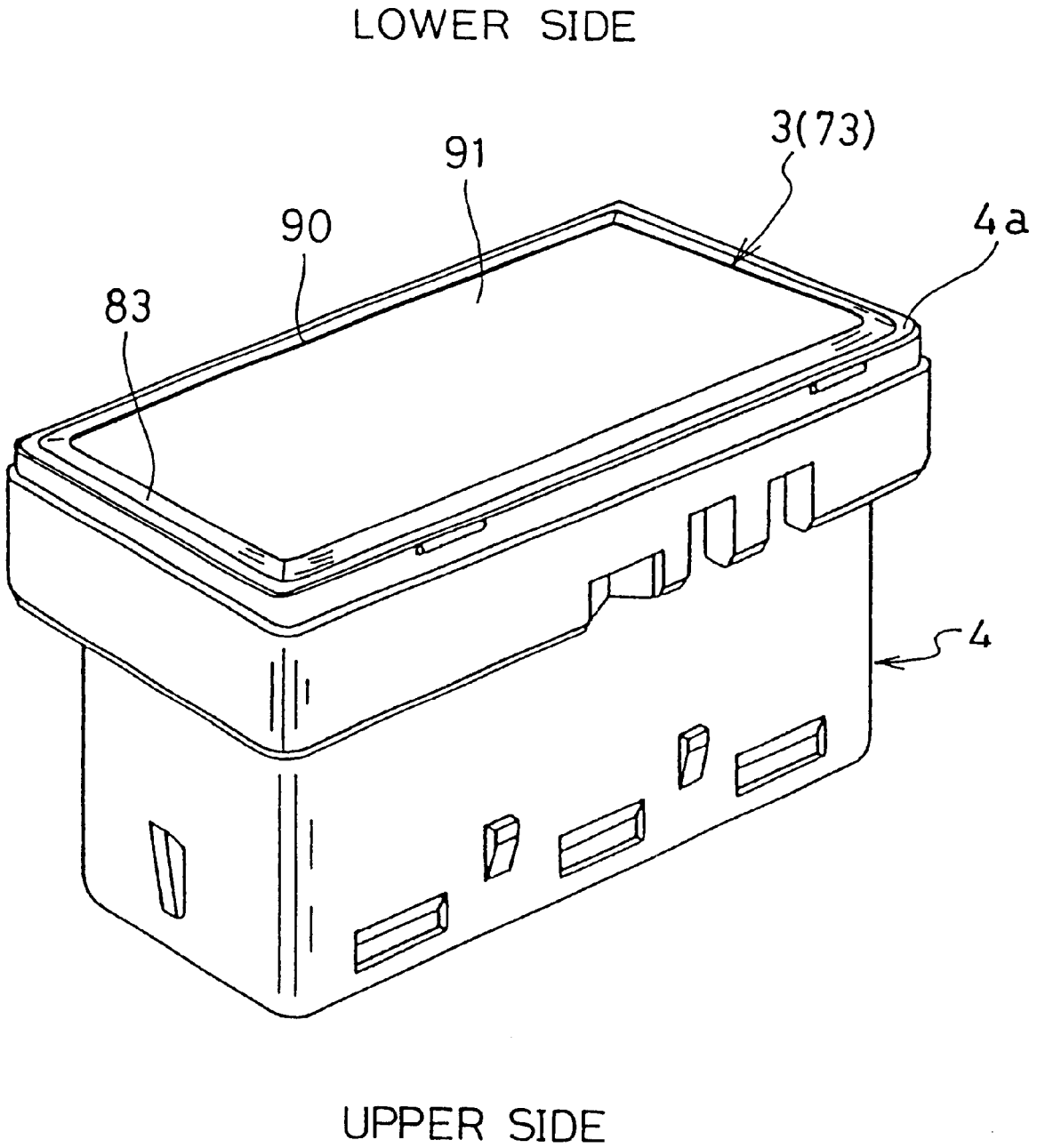
FIG. 22 is a perspective view which shows an application state of a sealant to a lower layer of the stamp material before the heat-press process, in the stamp unit of the second embodiment according to the present invention.
Figure 23:
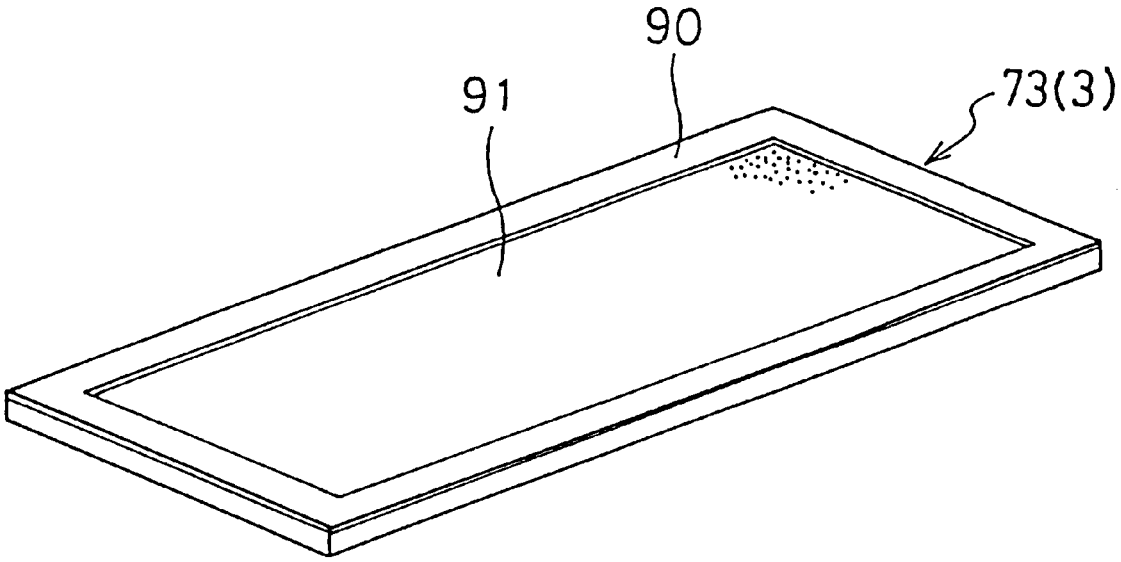
FIG. 23 is a perspective view of the stamp material which shows a state that the sealant is applied to the stamp material before the heat-press process.
Figure 24:
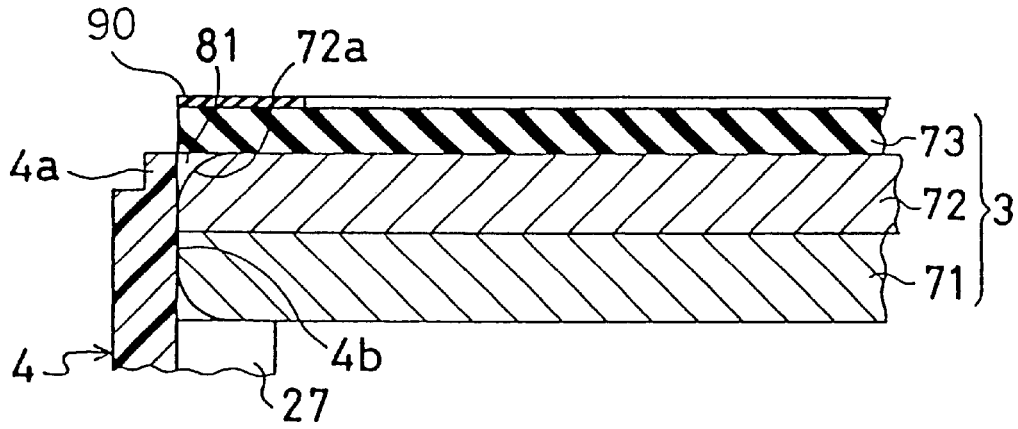
FIGS. 24(A) and (B) are cross sectional views which show the heat-press process between the holder and stamp material.
Figure 24:
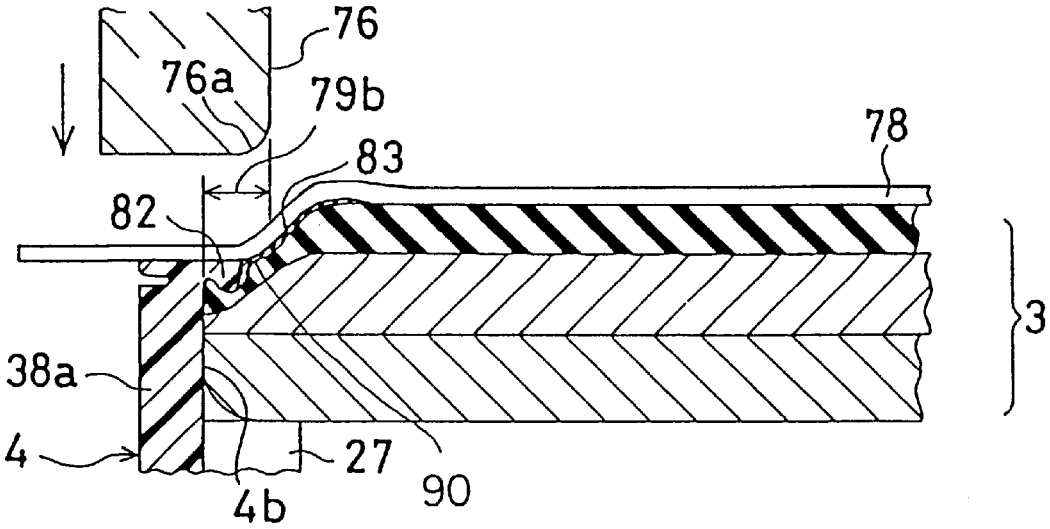

Referring to FIGS. 22 to 24, it will be described in detail heat-press process between the circumference of the lower layer 73 on which the sealant 90 is applied and the lower end of the holder 4. FIG. 22 is a perspective view of the holder 4 holding the stamp material 3 at its lower end, FIG. 23 is a perspective view of the stamp material 3 in a state that the sealant 90 is applied to the lower layer 73 of the stamp material 3 before the heat-press process, and FIGS. 24(A) and (B) are cross sectional views showing the heat-press process between the holder 4 and the stamp material 3.

In FIG. 22, only the lower layer 73 of the stamp material 3 is exposed from the lower end 4*a* of the holder 4, the lower end 4*a* being pressed and deformed. The circumference of the lower layer 73 along the lower end 4*a* is formed in the slant surface 83 so as to slightly project from the lower end 4*a*. The sealant 90 is applied to the slant surface 83. The flat area on the lower layer 73 surrounded by the sealant 90 becomes the effective stamp area 91. In the effective stamp area 91, the stamp surface is formed in which both the sealed portion (non-stamping portion) and the non-sealed portion (stamping portion) exist in a mixed state. Here, in a case that the effective stamp areas 91 exist on the central position of the flat lower layer 73 in a divided state, it may apply the sealant 90 to a portion corresponding to a dividing line. Further, it may apply the sealant 90 to a circumference covered by the holder 4 in the lower layer 73. In short, it may be enough that the sealant 90 is applied to the entire surface of the stamp material 3 exposed from the holder 4 except for the effective stamp area 91.

Preferably, the sealant 90 material has the following characteristics. First, such material must be adhered to continuous porous soft resin material forming the lower layer 73 of the stamp material 3, for instance, elastomer resin consisting of urethane resin being preferable for the lower layer 73. Second, material for the sealant 90 must have chemical resistance so as not to be destroyed by ink. Third, material for the sealant 90 must have viscosity and fluidity before being hardened so as to be able to saturate in pores formed in the porous soft resin for the lower layer 73, the pores having sizes in a range of 20±10 $\mu$m. Fourth, since the heat-press is done in a state that the sealant 90 is applied to the lower layer 73, material for the sealant 90 must have heat resistance so as not to be degenerated for the heat-press process at a temperature of 200° C. to 240° C. in a short time. Concretely, material for the sealant 90 must have heat resistance of more than 180° C. in a short time. Fifth, since the sealant 90 is elastically heat-pressed and deformed so that the circumference of the lower layer 73 is formed in the slant surface 83, the sealant 90 also must have rubber elasticity. Rubber elasticity must be preferably retained in a wide range of −55° C. to +200° C. Silicon rubber may be used as material for the sealant 90 which satisfies the above characteristics. Among silicon rubbers, it is conceivable to use liquid silicon rubber which is hardened in rubber state by condensation reaction at room temperature and further hardened while reacting with humidity in atmosphere.

As shown in FIG. 23, at first, the sealant 90 is applied to the circumference of one side of the lower layer 73 and hardened. It is preferable that the application thickness of the sealant 90 is in a range of 1.0 $\mu$m to 200 $\mu$m, more preferably in a range of 30 $\mu$m to 80 $\mu$m. If the application thickness of the sealant 90 is thin, the sealant 90 is apt to easily break by external force. However, if the application thickness of the sealant 90 exceeds a predetermined thickness, the sealant 90 will have proper strength, and thus becomes hard to break by external force. Further, if the thickness of sealant 90 is thinner than the predetermined thickness, the projection extent of the sealant 90 from the effective stamp area 91 does not hinder stamp operation. And if liquid silicon rubber is used for the sealant 90, liquid silicon rubber is saturated in continuous pores with usual diameter of 20±10 $\mu$m existing in the lower layer 73 and hardened in saturated state in pores. Therefore, the sealant 90 is not only adhered to the surface of the lower layer 73, but also entered into the lower layer 73. As a result, based on covering on and entering into the lower layer 73, the sealant 90 is firmly applied to the lower layer 73 and is not easily peeled off. The sealant 90 may be also applied to the side surface of circumference in the lower layer 73.

Heat-press process, which is done in a state that the sealant 90 is applied to the circumference of the stamp material 3 by using the heat-press jig 76 while the protect film 78 exists on the lower layer 73, is conducted by the same process as in the first embodiment. As shown in FIG. 18 explaining the first embodiment, the heat-press jig 76 is formed in a cylindrical form with rectangle according to a plan view thereof and controlled by a heat control device not shown. Here, heat temperature of the heat-press jig 76 to deform the stamp material 3 is set in a range of 200° C. to 240° C. The heat-press jig 76 has a heat-press area 77 according to its form as shown in FIG. 18.

A protect film 78 is constructed from a transparent resin film which is formed of resin such as PET (polyethylene terephthalate), PEN(polyethylene naphthalate), polyamide. Thin layer of silicon resin or fluoro resin is formed on the entire surface or partial surface corresponding to the heat-press area 77 of the heat-press jig 76 in the protect film 78, by conducting surface treatment of silicon resin or fluoro resin. The melting point of resin component forming the protect film 78 is prepared to a temperature which is lower than the heat temperature of the heat-press jig 76 and higher than the melting point of resin component included in the holder 4 and the stamp material 3. On the protect film 78, a heat-press portion 79 is formed corresponding to the heat-press area 77 of the heat-press jig 76. The heat-press portion 79 is divided into two heat-press portions 79*a*, 79*b*. The outer heat-press portion 79*a* corresponds to a welding portion where the lower layer 73 of the stamp material 3 and the inner side of lower end 4*a* of the holder 4 are mutually welded, and the inner heat-press portion 79*b* corresponds to a width of the lower end 4*a* in the holder 4 after being welded. Further, the protect film 78 has a holding portion 80 outside of the heat-press portion 79.

In FIG. 24, the stamp material 3 is shown in a reverse relation of up and down, thus the lower layer 73, the intermediate layer 72 and the upper layer 71 are shown in this order from the upper side. As mentioned above, the lower layer 73 is made of porous soft resin, in which optical energy absorbing substance such as carbon black is dispersed, such as urethane resin having pore ratio of about 65% and the sealant 90 is applied to the circumference of the lower layer 73, the intermediate layer 72 and the upper layer 71 are made of porous hard resin with 3 mm thickness such as vinylformal resin having pore ratio of about 90%. Further, likely to the stamp material 3, the holder 4 is shown in a reverse relation of up and down different from a case of stamping operation and the lower holder portion 31 is arranged upward, thus the lower end 4*a* is arranged upward. The upper layer 71 is pressed into an inner space 4*b* surrounded by the lower end 4*a* until the upper layer 71 contacts with the support posts 27. A spherical slant surface 71*a* forming circumference edge of the upper layer 71 faces the support posts 27, that is, the side from which ink is supplied. Further, the intermediate layer 72 is pressed into the inner space 4*b* until the intermediate layer 72 contacts with the upper layer 71. A spherical slant surface 72*a* forming a circumference edge of the intermediate layer 72 faces the lower layer 73 so as to oppose each other. The circumference of the lower layer 73 is formed into a plate-like flat form and adhered to the intermediate layer 72 through adhesive applied on the intermediate layer 72 with dot form.

The lower end 4*a* of the holder 4 is made thinner than the end 38*a* of the peripheral wall 38 formed in the lower holder portion 31. But, the side of the inner space 4*b* is continuously formed therethrough. The thickness of the lower end 4*a* is set so as to become equal to the thickness of the end 38*a* when the lower end 4*a* is heat-pressed and deformed.

The heat-press process is described hereinafter. To conduct the heat-press process between the lower end 4*a* of the holder 4 and the circumference of the stamp material 3, at first, the upper layer 71, the intermediate layer 72 and the lower layer 73 forming the stamp material 3 are arranged in the inner space 4*b* of the holder 4, as shown in FIG. 24(A). At this time, the lower layer 73 is entirely projected and exposed from the lower end 4*a* of the holder 4. There may be no problem if the lower layer 73 is partially inserted in the inner space 4*b* of the holder 4. In this state, the spherical slant surface 72*a* of the intermediate layer 72 opposes to the lower layer 73 and a space 81 is formed therebetween. This space 81 is used for a space in which the circumference of the lower layer 73 is flowed when the circumference of the lower layer 73 is deformed by the heat-press process.

Thereafter, as shown in FIG. 24(B), the protect film 78 is put on so as to cover the stamp surface on the lower layer 73 of the stamp material 3. Retaining this state, the heat-press jig 76 heated to a predetermined temperature is moved downward and retained a pressing state for a predetermined time (0.4 to 5 seconds, preferably 2 seconds). Thereby, the circumference of the lower layer 73 is flowed into the space 81 and the lower end 4*a* of the holder 4 is deformed as shown in FIG. 24(B). Here, since the wall of the inner space 4*b* of the holder 4 is formed straightly, the lower end 4*a* can be easily deformed toward the inner space 4*b*. Therefore, the lower end 4*a* encroaches into the deformed circumference of the lower layer 73 and forms a hook-like wedge 82, as shown in FIG. 24 (B). This wedge 82 serves to hook the circumference of the lower layer 73 to which the sealant 90 is applied while holding the contact state between the lower end 4*a* and the circumference of the lower layer 73 so as to seal. The portion of the lower layer 73 opposite to the wedge 82 of the lower end 4*a* is deformed so as to adhere to the end 38*a* of the peripheral wall 38.

By the heat-press process, a slant surface 83 with the sealant 90 of the circumference of the stamp material 3 is formed, based on that the lower end 4*a* of the holder 4 and the circumference of the lower layer 73 are deformed. To accomplish this, the heat-press jig 76 is constructed so as to have a spherical slant surface 76*a* at the inner side thereof, corresponding to the inner heat-press portion 79*b* of the protect film 78. Since the protect film 78 exists between the lower layer 73 and the heat-press jig 76 when heat-press process is conducted, the slant surface 83 of the circumference in the stamp material 3 becomes a smooth slant surface without difference in level. At the same time, the protect film 78 is welded to a flat portion of the deformed lower end 4*a* in the holder 4, in a condition that the protect film 78 can be peeled off. As mentioned, the stamp material 3, the holder 4 and the protect film 78 are heat-pressed by the heat-press jig 76 at the same time. As explained above, the lower end 4*a* of the holder 4 and the lower layer 73 of the stamp material 3 are mutually hooked by the wedge 82 while holding the contact state between the lower end 4*a* and the circumference of the lower layer 73 so as to seal, therefore it can surely seal the lower layer 73 and the lower end 4*a*. As a result, it can prevent ink from leaking between the stamp material 3 and the holder 4. In order to efficiently conduct the heat-press process, it is effective to: ① make the lower end 4*a* thin and form the inner side thereof straight; ② form spherical slant surface 72*a* in the circumference of the intermediate layer 72; and ③ form the support posts 27 to support the circumference of the stamp material 3.

Since the lower end 4*a* of the holder 4 is deformed so as to have the wedge 82 which hooks the circumference of the lower layer 73 with the sealant 90, it can retain the seal state between the lower end 4*a* of the holder 4 and the circumference of the lower layer 73, even after many stamping operations are repeated. Therefore, seal ability between the holder 4 and the stamp material 3 can be remarkably improved.

In the second embodiment, the process to form the stamp surface on the stamp material 3 is basically as same as the process in the first embodiment. Different point is as follows. That is, when the stamp surface is formed on the stamp material 3, the sealant 90 is applied to the circumference of the lower layer of the stamp material 3. At this time, since the sealant 90 is made black, the sealant 90 is heated when the xenon tube in the stamp making device is driven to emit light while opposing the stamp material 3*a* and the positive manuscript in the state that the acrylic plate exists between the stamp material 3 and the positive manuscript. Based on this heating of the sealant 90, both the lower layer 73 of the stamp material 3 and the sealant 90 are more firmly adhered. Further, if the sealant 90 is made transparent, the portion of the lower layer 73 corresponding to the sealant 90 is heated. Thus, based on this heating of the lower layer 73, both the lower layer 73 and the sealant 90 are more firmly adhered.

And in the second embodiment, assembling procedure of the stamp unit 1 is as same as the procedure in the first embodiment, thus explanation of the procedure will be omitted.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

For instance, though the stamp unit 1 of the first embodiment is preferably described as the stamp unit in which the stamp surface of the stamp material 3 is formed by setting the holder with the stamp material in the stamp making device, the invention is not limited to this type of the stamp unit. It is important that the invention can be applied to the stamp unit in which the holder is slidably retained in the skirt member by inserting the holder in the skirt member from the lower side thereof based on the resilient member arranged in the skirt member to urge the holder upward in the skirt member, and the grip member is connected to the upper side of the holder, thereby the stamp unit is assembled.

Figure 25:
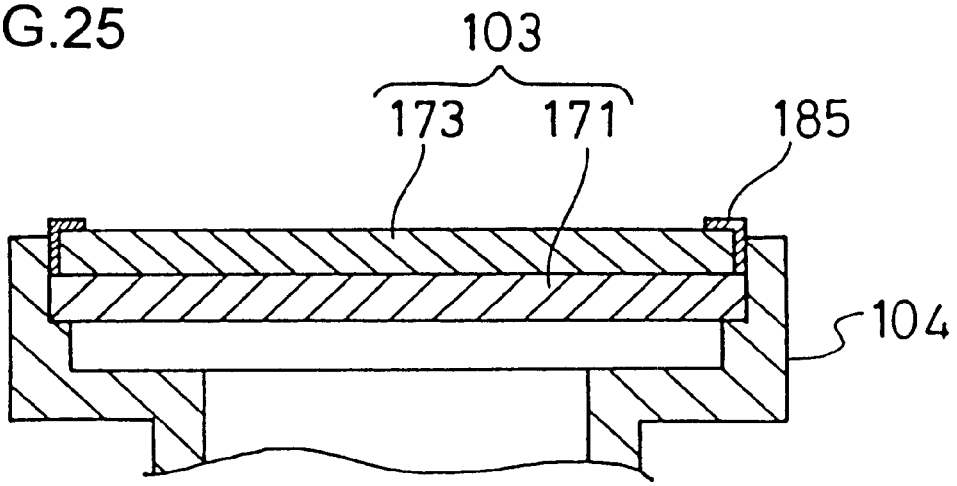
FIG. 25 is a schematic cross sectional view of the main part of the stamp unit according to a modification of the second embodiment.

Further, in the second embodiment, as shown in FIG. 25, the second embodiment may be modified. That is, the stamp unit is constructed from the stamp material 103 and the holder 104. The stamp material 103 has a two-layered construction in which the porous soft resin layer 173 and the porous hard resin layer 171 are formed. Further, as shown in FIG. 25, the sealant 185 is applied to both the circumference and circumferential side of the porous soft resin layer 173. Both the porous soft resin layer 173 and the porous hard resin layer 171 are inserted in the inner space of the holder 104, thus stamp unit is constructed. In such structure, since thickness of the sealant 185 is thin, it is not necessary to make the circumference of the porous soft resin layer 173 in a slant surface.

Figure 26:
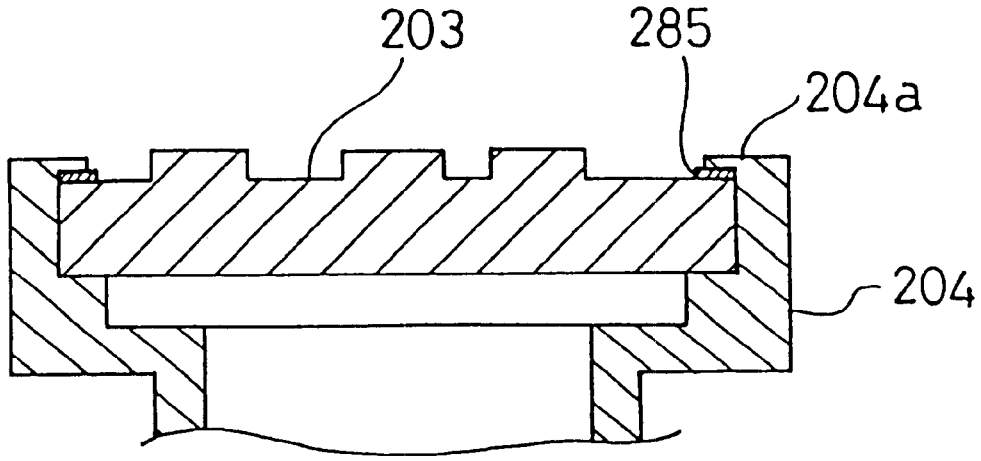
FIG. 26 is a schematic cross sectional view of the main part of the stamp unit according to another modification of the second embodiment.

Further, the stamp unit of the second embodiment may be modified as shown in FIG. 26. That is, the stamp material 203 is formed of the porous hard resin and has stamping portions projected from the bending portion 204*a* of the holder 204. The sealant 285 is applied to the circumference of the stamp material 203 and the stamp material 203 is held with the sealant 285 by the bending portion 204*a*.

What is claimed is:

1. A stamp unit including a holder member having an end, a stamp material made of porous material retained by the holder member, the stamp material having a front surface projected from the end of the holder member and a circumference portion, wherein the front surface includes an effective stamp surface comprising a stamping portion and a non-stamping portion, and the circumference portion is defined at least by an area existing between positions corresponding to the end of the holder member and the effective stamp surface, within an exposed area of the stamp material from the holder member, the area being entirely covered by a sealant.

2. A process for producing the stamp unit according to claim 1, wherein the sealant is formed by curing a liquid sealing material that is applied to the circumference portion.

3. The stamp unit according to claim 1, wherein the sealant has rubber elasticity being in a range of −55° C. to +200° C.

4. A process for producing the stamp unit according to claim 3, wherein the sealant is formed by curing a liquid sealing material that is applied to the circumference portion.

5. The stamp unit according to claim 1, wherein the sealant is saturated in pores formed in the porous material.

6. A process for producing the stamp unit according to claim 5, wherein the sealant is formed by curing a liquid sealing material that is applied to the circumference portion.

7. The stamp unit according to claim 1, wherein a thickness of the sealant which covers the circumference portion is in a range of 1.0 $\mu$m to 200 $\mu$m.

8. A process for producing the stamp unit according to claim 7, wherein the sealant is formed by curing a liquid sealing material that is applied to the circumference portion.

9. The stamp unit according to claim 1, wherein the sealant has resistance of more than 180° C. in a short time.

10. A process for producing the stamp unit according to claim 9, wherein the sealant is formed by curing a liquid scaling material that is applied to the circumference portion.

11. The stamp unit according to claim 1, wherein the sealant is silicone rubber.

12. A process for producing the stamp unit according to claim 11, wherein the sealant is formed by curing a liquid sealing material that is applied to the circumference portion.

13. The stamp unit according to claim 1, wherein the front surface includes at least a part of the circumference portion.

14. The stamp unit according to claim 1, wherein a part of the circumference portion is deformed so as to contact with an inner wall of the end of the holder member.

* * * * *